US007358984B2

(12) United States Patent
Hoshizaki et al.

(10) Patent No.: US 7,358,984 B2
(45) Date of Patent: Apr. 15, 2008

(54) IMAGE FORMING APPARATUS INCLUDING MULTIBEAM EXPOSURE UNIT HAVING SURFACE EMITTING LASER ARRAY

(75) Inventors: Taketoshi Hoshizaki, Kanagawa (JP); Hidemi Nukada, Kanagawa (JP); Takahiro Suzuki, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 324 days.

(21) Appl. No.: 10/683,279

(22) Filed: Oct. 14, 2003

(65) Prior Publication Data

US 2004/0183885 A1 Sep. 23, 2004

(30) Foreign Application Priority Data

Mar. 19, 2003 (JP) ..... 2003-075993

(51) Int. Cl.
*B41J 2/435* (2006.01)

(52) U.S. Cl. ..... 347/262; 347/264

(58) Field of Classification Search ..... 347/233, 347/262, 264, 169; 359/204; 430/58.15, 430/58.1, 56, 130, 53, 58.05; 346/5, 138; 399/128, 159

See application file for complete search history.

(56) References Cited

U.S. PATENT DOCUMENTS

| | | | | |
|---|---|---|---|---|
| 4,341,851 | A * | 7/1982 | Mooney et al. | 430/56 |
| 4,618,560 | A * | 10/1986 | Borsenberger et al. | 430/130 |
| 5,173,384 | A * | 12/1992 | Otsuka | 430/58.15 |
| 5,759,725 | A * | 6/1998 | Hirao et al. | 430/58.1 |
| 6,833,939 | B1 * | 12/2004 | Ichikawa | 359/204 |
| 7,030,895 | B2 * | 4/2006 | Aoki et al. | 347/115 |

FOREIGN PATENT DOCUMENTS

| | | |
|---|---|---|
| JP | 04-338967 | 11/1992 |
| JP | 05-294005 A | 11/1993 |
| JP | 09-068816 A | 3/1997 |
| JP | 10-268529 A | 10/1998 |
| JP | 2000-105479 A | 4/2000 |
| JP | 2001-311898 A | 11/2001 |
| JP | 2001-330976 A | 11/2001 |
| JP | 2002-174920 A | 6/2002 |

* cited by examiner

*Primary Examiner*—Hai Pham
(74) *Attorney, Agent, or Firm*—Oliff & Berridge, PLC

(57) ABSTRACT

An image forming apparatus includes: an electrophotographic photoreceptor having a conductive substrate and a photosensitive layer provided on the conductive substrate; a charging unit for charging the electrophotographic photoreceptor; an exposure unit for exposing the charged electrophotographic photoreceptor to light thereby forming an electrostatic latent image; a developing unit for developing the electrostatic latent image with toner thereby forming a toner image; and a transfer unit for transferring the toner image from the electrophotographic photoreceptor to a transferred image-receiving medium. The exposure unit is a multi beam exposure unit which has a surface emitting laser array and which carries out the electrostatic latent image formation by scanning the electrophotographic photoreceptor with eight or more light beams where electrophotographic photoreceptor gives a quantum efficiency of 0.3 or higher when the electrophotographic photoreceptor is charged to a charged potential absolute value of 500 V and then irradiated with a monochromatic light of the same wavelength as that of the light beams to decay the charged potential absolute value to 250 V.

10 Claims, 9 Drawing Sheets

IMAGE FORMING APPARATUS INCLUDING MULTIBEAM EXPOSURE UNIT HAVING SURFACE EMITTING LASER ARRAY

FIELD OF THE INVENTION

The present invention relates to an image forming apparatus for effecting an image formation by an electrophotographic process including steps of charging, exposure, development, transfer, etc.

BACKGROUND OF THE INVENTION

In an image forming apparatus of an electrophotographic process, for forming an electrostatic latent image on a charged electrophotographic photoreceptor, there is known a method of scanning the electrophotographic photoreceptor with plural light beams (hereinafter called "multi-beam method"). See, for example, patent document 1.

Patent Document 1: JP 2002-303997 A

The image forming apparatus of such multi-beam method is considered advantageous for elevating the speed of an image forming process, but is not necessarily satisfactory in the image quality, particularly in the case of employing a surface emitting laser array capable of increasing the number of lasers. More specifically, an electrostatic latent image formed on the electrophotographic photoreceptor includes areas with different numbers of scanning (i.e., number of irradiations)) by the light beam until the end of the exposure, and such difference in the number of irradiations between such areas may result in observation of a streak-shaped density unevenness.

FIG. 11 is a chart showing a distribution of an exposure energy along a moving direction (sub-scanning direction) of the electrophotographic photoreceptor in the case where 30 laser beams of a spot diameter of 50 μm are made to scan an electrophotographic photoreceptor to perform scanning of simultaneous 30 scan lines (with scanning line density of 2600 dpi (the term "dpi" means dot per inch)) per one main scan and the electrophotographic photoreceptor is moved to shift the scanning lines by a distance equivalent to 30 scanning lines for every main scan.

As shown in the drawing, the exposure energy distribution in each main scanning becomes approximately trapezoidal. Amoung the exposure energy distribution given to the electrophotographic photoreceptor in each main scan, a flat part corresponding to a top portion of the trapezoid is an area where the total exposure energy is given by a single exposure (single exposure area), while a sloped part of the trapezoid corresponds to an area where the total exposure energy is given by two exposures (multiple exposure area).

According to an investigation of the present inventors, even in the case where the total exposure energy in the multiple exposure area is equal to that of the single exposure area, an actually obtained image shows a higher image density in the multiple exposure area than in the single exposure area, whereby a streak-shaped density unevenness is generated.

SUMMARY OF THE INVENTION

The present invention has been made in consideration of the above-described problems in the prior technology, and an object of the invention is to provide an image forming apparatus capable of sufficiently suppressing the generation of streak-shaped density unevenness even in the case of employing a surface emitting laser array that can increase the number of lasers, thereby realizing both an improvement in the image quality and an increase in the image forming speed.

Other objects and effects of the invention will become apparent from the following description.

The objects of the present invention have been achieved by providing an image forming apparatus comprising:

an electrophotographic photoreceptor having a conductive substrate and a photosensitive layer provided on the conductive substrate;

a charging unit for charging the electrophotographic photoreceptor;

an exposure unit for exposing the charged electrophotographic photoreceptor to light thereby forming an electrostatic latent image;

a developing unit for developing the electrostatic latent image with toner thereby forming a toner image; and a transfer unit for transferring the toner image from the electrophotographic photoreceptor to a transferred image-receiving medium, wherein the exposure unit is a multi beam exposure unit which has a surface emitting laser array and which carries out the electrostatic latent image formation by scanning the electrophotographic photoreceptor with eight or more light beams, and wherein the electrophotographic photoreceptor has a quantum efficiency of 0.3 or higher when the electrophotographic photoreceptor is charged to a charged potential absolute value of 500 V and then irradiated with a monochromatic light of the same wavelength as that of the light beams to decay the charged potential absolute value to 250 V.

The image forming apparatus of the invention, by employing: an exposure unit including a surface emitting laser array and adapted to scan the electrophotographic photoreceptor with eight or more light beams to form an electrostatic latent image; and an electrophotographic photoreceptor giving a quantum efficiency satisfying the aforementioned specific requirement, is capable of attaining a uniform density of the electrostatic latent image at a higher level, and attaining a sufficiently uniform density even in the case where the electrostatic latent image includes areas different in the number of irradiations with the light beam, thereby sufficiently suppressing the generation of streak-shaped density unevenness and realizing both speeding up of an image forming process and improvements in image qualities. The quantum efficiency referred to in the invention means the number of charges (xerographic gain) on the surface of the electrophotographic photoreceptor, neutralized by a displacement of carriers generated by photoexcitation, per a photon irradiating the electrophotographic photoreceptor. Such quantum efficiency can be represented by the following equation (B):

$$\eta=(C\cdot h\cdot\nu/e)\cdot(dV/dE) \quad \text{(B)}$$

wherein C represents the electrostatic capacity of an electrophotographic photoreceptor; h represents the Planck's constant; ν represents the frequency of an exposing light; e represents the charge of an electron; and dV/dE represents the potential decay rate of the electrophotographic photoreceptor per a unit irradiation amount. In the equation (B), dV/dE means a decay rate when the charged potential (absolute value) of the electrophotographic photoreceptor is decayed from 500 V to 250 V. Also in the equation (B), C can be determined by charging and exposing an electrophotographic photoreceptor under rotation; measuring a flowing current (I) into the electrophotographic photoreceptor and a potential decay amount of the electrophotographic photoreceptor; then calculating a flow-in charge amount (Q) per unit area from a process speed and an exposure width; and obtaining C=dQ/dV from an inclination of the flow-in charge amount (Q) per unit area and the potential decay amount (V).

In the invention, the photosensitive layer of the electrophotographic photoreceptor preferably includes at least one charge generating material selected from hydroxygallium phthalocyanine, chlorogallium phthalocyanine, oxytitanium phthalocyanine and a trisazo pigment. Use of the specific charge generating material improves the sensitivity of the electrophotographic photoreceptor, thereby achieving an increase of the image forming speed and an improvement of the image quality at a higher level.

In the invention, it is preferred that the photosensitive layer of the electrophotographic photoreceptor includes at least one selected from:

hydroxygallium phthalocyanine having diffraction peaks at least at 7.6° and 28.2° in terms of the Bragg angle (2θ±0.2°) of an X-ray diffraction spectrum using CuKα radiation;

chlorogallium phthalocyanine having diffraction peaks at least at 7.4°, 16.6°, 25.5° and 28.3° in terms of the Bragg angle (2θ±0.2°) of an X-ray diffraction spectrum using CuKα radiation; and a trisazo pigment represented by either one of general formulas (1) to (4) shown below. Use of such charge generating material can sufficiently suppress a change of the sensitivity of the electrophotographic photoreceptor under different environments, thereby being advantageous in reducing the load to the exposure unit in the case of a surface emitting laser array, which has a narrower control range of a light emission amount in comparison with an end face light emission laser.

(1)

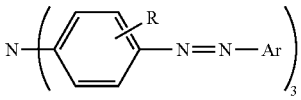

(2)

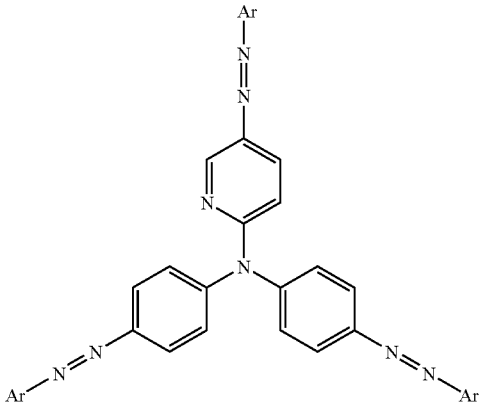

-continued (3)

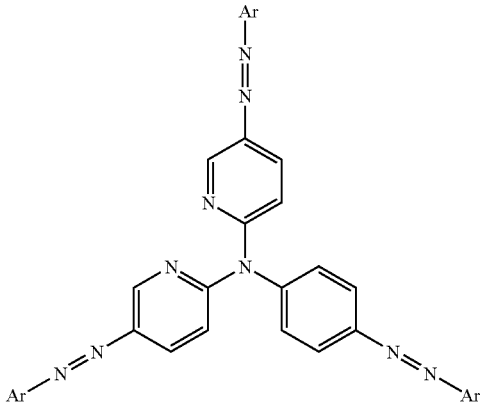

(4)

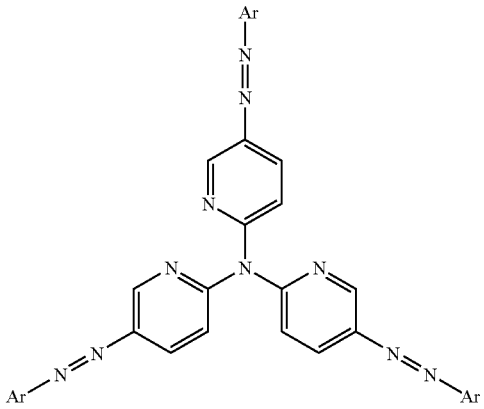

wherein, in the formulas (1) to (4), R represents a hydrogen atom, a halogen atom, an alkyl group, an alkoxy group or a cyano group; and Ar represents a coupler residue.

Also in the invention, it is preferred that the image forming apparatus has a resolution of 1200 dpi or higher, more preferably 2400 dpi or higher. In the case of a resolution of 1200 dpi or higher, a width of plural dots can be scanned in one operation with the planar light emission laser, whereby the number of scanning operations can be reduced and the load on the exposure unit can be reduced.

Also in the invention, it is preferred that the surface emitting laser array has light emitting points arranged two-dimensionally. It is thus possible to easily increase the number of light beams which scan the electrophotographic photoreceptor, thereby more effectively increasing the image forming speed.

Also in the invention, the exposure unit causes eight or more light beams to scan the electrophotographic photoreceptor, and adjacent ones of the light beams on the electrophotographic photoreceptor have a scanning interval of 0.15 mm or larger, more preferably 0.2 mm or larger and further preferably 0.3 mm or larger. A scanning interval of light beams, i.e., a pitch of stripes, equal to or larger than 0.15 mm improves the visibility, whereby the effect of the invention becomes more conspicuous.

Also in the invention, it is preferred that, when the electrophotographic photoreceptor is charged to a charged potential absolute value of 500 V and then irradiated with a monochromatic light of the same wavelength as that of the light beams to decay the charged potential absolute value to 250 V, a half decay exposure amount satisfies the relationship represented by the following expression (A):

$$E_L/E_M \leqq 1.15 \quad \text{(A)}$$

wherein $E_L$ represents a half decay exposure amount under the conditions of 10° C. and 15% RH, and $E_M$ represents a half decay exposure amount under the conditions of 22° C. and 50% RH. The half decay exposure amounts satisfying the foregoing relationship allows to reduce a load to the planar light emission laser having a small output control range, thereby securely preventing the generation of streak-shaped unevenness.

DETAILED DESCRIPTION OF THE INVENTION

Figure 1:
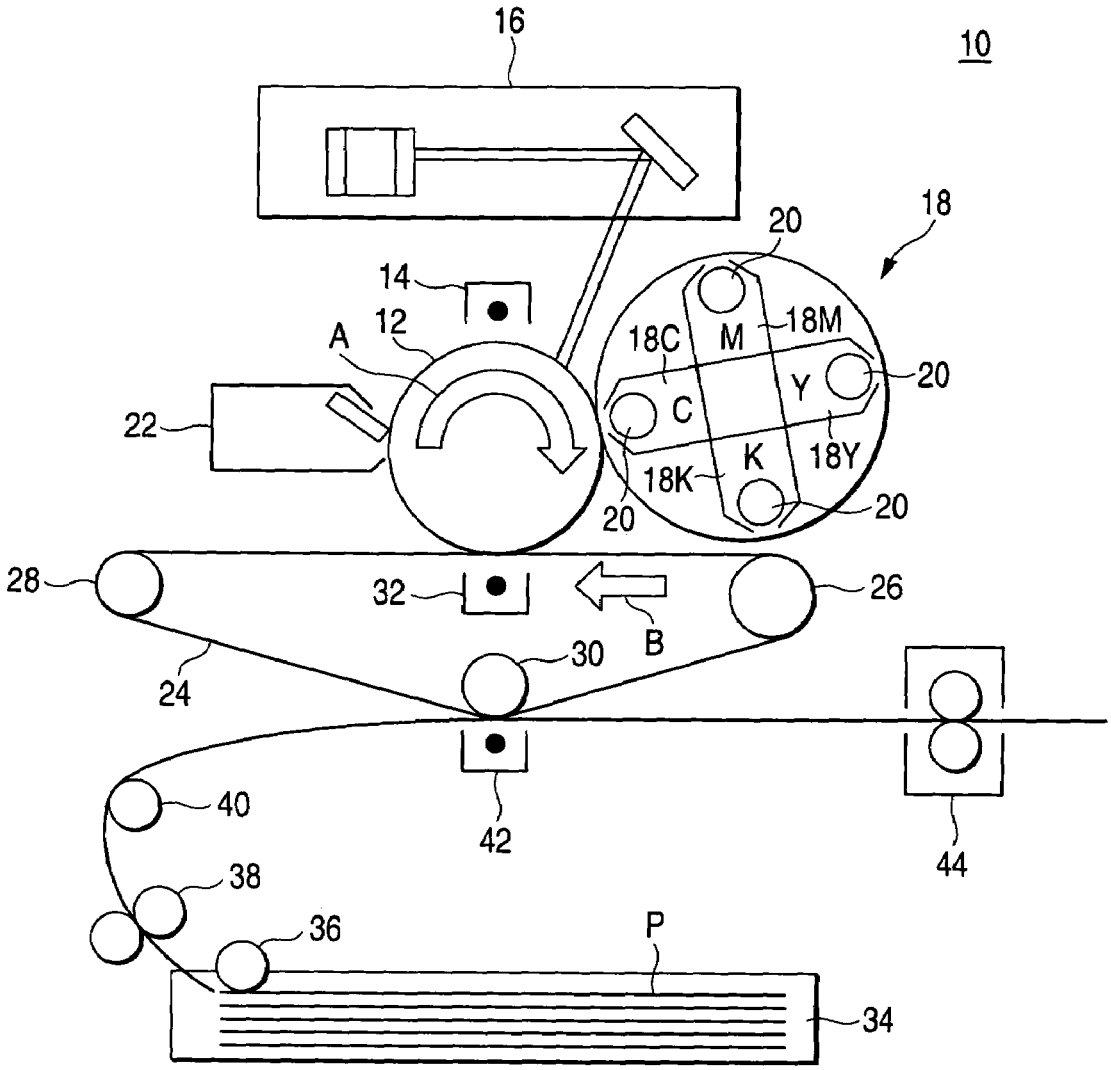
FIG. 1 is a schematic configurational view showing a preferred embodiment of an image forming apparatus of the present invention.

In the following, there will be explained preferred embodiments of the present invention, occasionally referring to the accompanying drawings. In the drawings, same or equivalent parts will be represented by the same symbol, and duplicating explanation will be omitted.

FIG. 1 is a schematic view showing a first embodiment of the image forming apparatus of the present invention. An image forming apparatus 10 shown in FIG. 1 is equipped with an electrophotographic photoreceptor 12, which is rendered rotatable in a direction indicated by an arrow A at a predetermined rotation speed by driving apparatus (not shown). Though details being described below, the electrophotographic photoreceptor 12 has a photosensitive layer on an external periphery of a drum-shaped conductive substrate, and has a quantum efficiency satisfying a specific condition. More specifically, the electrophotographic photoreceptor 12 gives a quantum efficiency of 0.3 or higher when the electrophotographic photoreceptor 12 is charged to a charged potential absolute value of 500 V and then irradiated with a monochromatic light of the same wavelength as that of the light beams of an exposure unit 16 described below, to decay the charged potential absolute value to 250 V. The quantum efficiency is more preferably 0.5 or higher, further preferably 0.6 or higher.

A charger 14 for charging the external periphery of the electrophotographic photoreceptor 12 is provided substantially above the electrophotographic photoreceptor 12.

Also substantially above the charger 14, there is provided an exposure unit (light beam scanning apparatus) 16. Although the details will be described below, the exposure unit 16 modulates 8 or more laser beams, emitted from a light source utilizing a surface emitting laser array, according to an image to be formed, and deflects the beams in a main scanning direction, thereby scanning the external periphery, charged by the charger 14, of the electrophotographic photoreceptor 12 in a direction parallel to an axis thereof.

At a side of the electrophotographic photoreceptor 12, there is provided a developing unit 18. The developing unit 18 is provided with a roller-shaped housing body, which is rendered rotatable. Inside the housing body, there are provided four housing units, in which developing devices 18Y, 18M, 18C, 18K are respectively provided. The developing devices 18Y, 18M, 18C, 18K are respectively provided with developing rollers 20 and respectively store toners of yellow (Y), magenta (M), cyan (C) and black (K) colors.

Also substantially below the electrophotographic photoreceptor 12, an endless intermediate transfer belt 24 is provided. The intermediate transfer belt 24 is supported about rollers 26, 28, 30 and is so positioned as to be in contact with the external periphery of the electrophotographic photoreceptor 12. The rollers 26 to 30 are rotated by a driving power of a motor (not shown), thereby rotating the intermediate transfer belt 24 in a direction indicated by an arrow.

A transfer device 32 is positioned opposite to the electrophotographic photoreceptor 12, across the intermediate transfer belt 24. A toner image formed on the external periphery of the electrophotographic photoreceptor 12 is transferred, by the function of the transfer device 32, onto an image forming surface of the intermediate transfer belt 24.

Below the intermediate transfer belt 24, there is provided a tray 34, which contains a plurality of papers P as a recording material in a stacked state. At upper left, in FIG. 3, of the tray 34 there is provided a pick-up roller 36, and a roller pair 38 and a roller 40 are provided sequentially at a downstream side of a pickup direction of the paper P by the pickup roller 36. An uppermost recording paper in the stack is picked up from the tray by the rotation of the pickup roller 36 and is transported by the roller pair 38 and the roller 40.

Also a transfer device 42 is positioned opposite to the roller 30, across the intermediate transfer belt 24. The paper P, transported by the roller pair 38 and the roller 40 is fed into a gap between the intermediate transfer belt 24 and the transfer device 42, wherein a toner image formed on the image forming surface of the intermediate transfer belt 24 is transferred by the transfer device 42. At a downstream side of the transfer device 42 in the transporting direction of the paper P, a fixing device 44 having a pair of fixing roller is provided, and the paper P bearing the transferred toner image is subjected to a fixation thereof by fusion in the fixing device 44, then is discharged from a body of the image forming apparatus 10 and is placed on a discharge tray (not shown). The fixing device 44 corresponds to fixing means in claim 1.

Also opposite to the developing unit 18 and across the electrophotographic photoreceptor 12, there is provided a charge eliminating/cleaning device 22 having functions of charge elimination of the external periphery of the electrophotographic photoreceptor 12 and of elimination of unnecessary toner remaining on the external periphery. After the toner image formed on the external periphery of the electrophotographic photoreceptor 12 is transferred onto the intermediate transfer belt 24, an area which had borne the toner image for transfer, in the external periphery of the electrophotographic photoreceptor 12, is cleaned by the charge eliminating/cleaning device 22.

In the image forming apparatus 10 shown in FIG. 1, a full-color image is formed during a course of four turns of the electrophotographic photoreceptor 12. More specifically, in the course of 4 turns of the electrophotographic photoreceptor 12, the charger 14 continues the charging of the external periphery of the electrophotographic photoreceptor 12 while the charge eliminating/cleaning device 22 continues the charge elimination of the external periphery, and the exposure unit 16 repeats scanning of the external periphery of the electrophotographic photoreceptor 12 with laser beams modulated according to one of Y, M, C, K image data representing an image to be formed, while switching the image data employed for modulating the laser beams for every turn of the electrophotographic photoreceptor 12. Also the developing unit 18 repeats an activation, in a state in which the developing roller 20 of any of the developing devices 18Y, 18M, 18C, 18K is opposed to the external periphery of the electrophotographic photoreceptor 12, of the developing device positioned opposed to the external periphery thereby developing the electrostatic latent image, formed on the external periphery of the electrophotographic photoreceptor 12, in a specific color and forming a toner image of such a specific color on the external periphery of the electrophotographic photoreceptor 12, while rotating the housing body so as to switch the developing device employed for developing the electrostatic latent image, at every turn of the electrophotographic photoreceptor 12.

Thus, in every turn of the electrophotographic photoreceptor 12, toner images of Y, M, C, K colors are formed sequentially and in a mutually superposed state on the external periphery of the electrophotographic photoreceptor 12, and after 4 turns of the electrophotographic photoreceptor 12, a full-color toner image is formed on the external periphery of the electrophotographic photoreceptor 12.

As explained in the foregoing, the use of the exposure unit 16 of multi beam type for scanning the electrophotographic photoreceptor with plural light beams for forming an electrostatic latent image and the use of the electrophotographic photoreceptor 12 which gives a half decay exposure amount satisfying the aforementioned specific condition can provide a sufficiently uniform density even in the case where the electrostatic latent image includes areas with different numbers of light irradiations, thereby sufficiently suppressing the generation of streak-shaped density unevenness and achieving both speeding up of the image forming process and improvements in the image qualities.

In the following, there will be given a detailed explanation on preferred examples of the electrophotographic photoreceptor 12 and the exposure unit 16.

FIGS. 2 to 5 are schematic cross-sectional views showing preferred examples of the electrophotographic photoreceptor 12, in partial cross-sectional views in which the electrophotographic photoreceptor 12 is cut along a direction of lamination of the conductive substrate 2 and the photosensitive layer 3.

Figure 2:
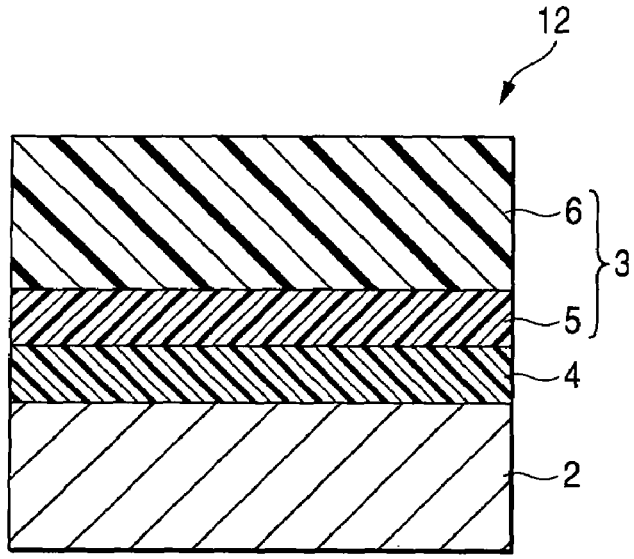
FIG. 2 is a schematic cross-sectional view showing an example of an electrophotographic photoreceptor of the invention.
Figure 3:
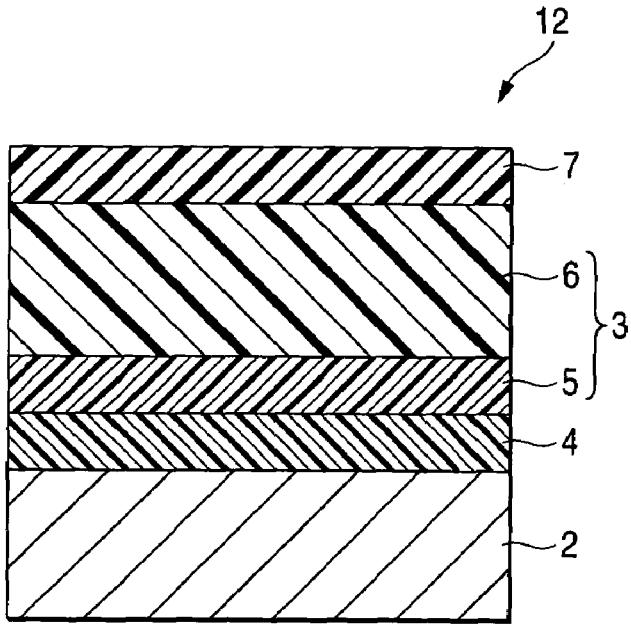
FIG. 3 is a schematic cross-sectional view showing an example of an electrophotographic photoreceptor of the invention.
Figure 4:
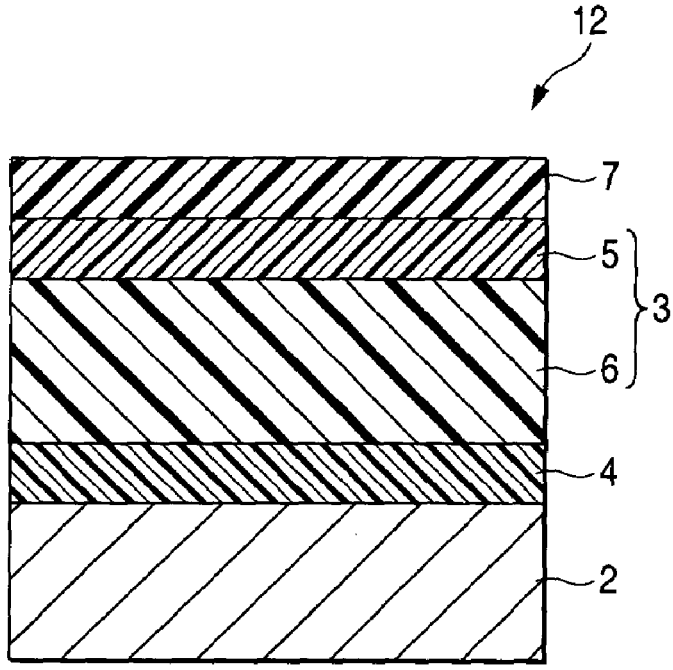
FIG. 4 is a schematic cross-sectional view showing an example of an electrophotographic photoreceptor of the invention.

The electrophotographic photoreceptor 12 shown in FIGS. 2 to 4 is provided with a photosensitive layer 3 which is functionally separated into a layer containing a charge generating material (charge generating layer 5) and a layer containing a charge transport material (charge transport layer 6).

The electrophotographic photoreceptor 12 shown in FIG. 2 has a structure in which an undercoat layer 4, a charge generating layer 5 and a charge transport layer 6 are laminated sequentially on a conductive substrate 2.

The electrophotographic photoreceptor 12 shown in FIG. 3 has a structure in which an undercoat layer 4, a charge generating layer 5, a charge transport layer 6 and a protective layer 7 are laminated sequentially on a conductive substrate 2.

The electrophotographic photoreceptor 12 shown in FIG. 4 has a structure in which an undercoat layer 4, a charge transport layer 6, a charge generating layer 5 and a protective layer 7 are laminated sequentially on a conductive substrate 2.

Figure 5:
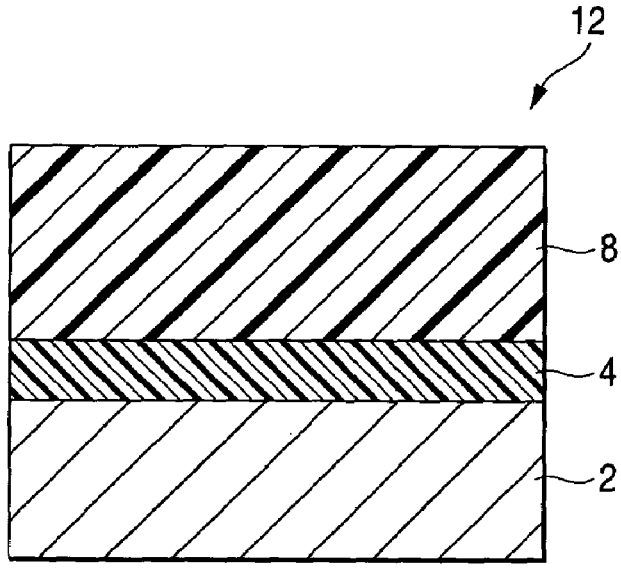
FIG. 5 is a schematic cross-sectional view showing an example of an electrophotographic photoreceptor of the invention.
Figure 6:
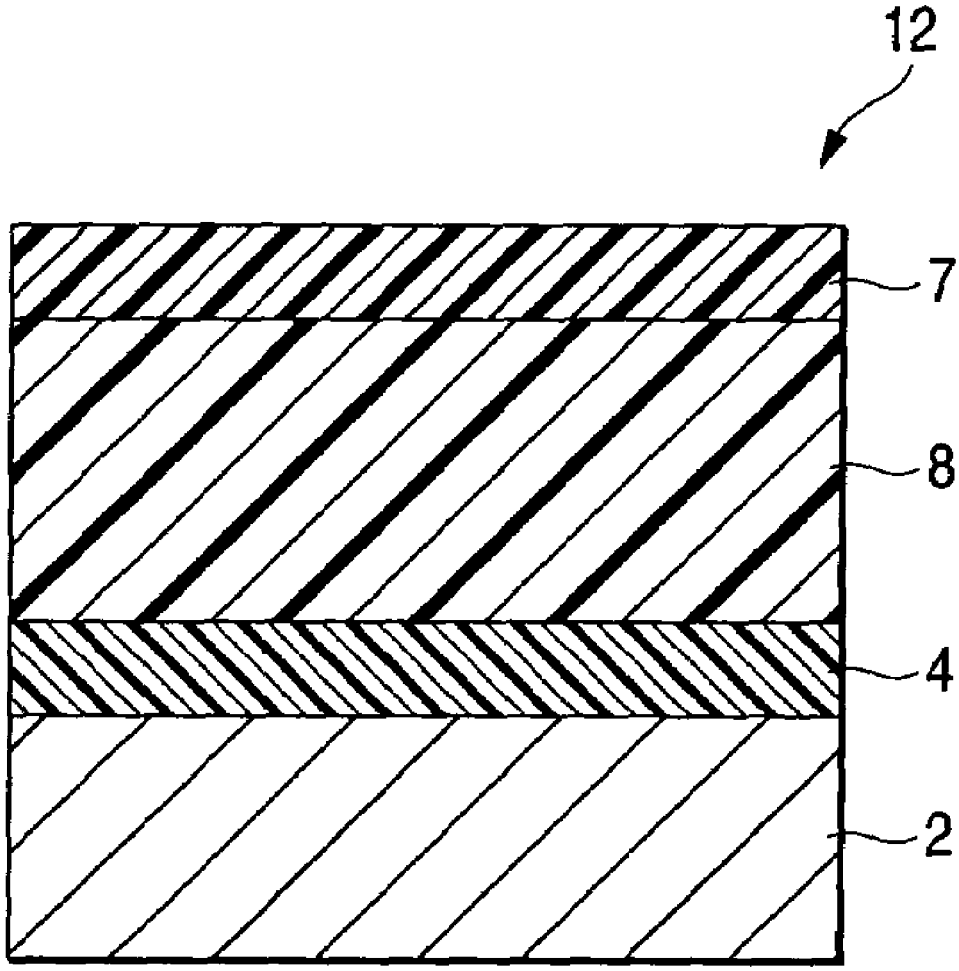
FIG. 6 is a schematic cross-sectional view showing an example of an electrophotographic photoreceptor of the invention.

On the other hand, the electrophotographic photoreceptor 12 shown in FIGS. 5 to 6 includes a charge generating material and a charge transport material in a same layer (single-layered photosensitive layer 8).

The electrophotographic photoreceptor 12 shown in FIG. 5 has a structure in which an undercoat layer 4 and a single-layered photosensitive layer 8 are laminated sequentially on a conductive substrate 2.

The electrophotographic photoreceptor 12 shown in FIG. 6 has a structure in which an undercoat layer 4, a single-layered photosensitive layer 8 and a protective layer 7 are laminated sequentially on a conductive substrate 2.

In the following there will be given a detailed explanation on each component of the electrophotographic photoreceptor 12.

The conductive substrate 2 can be a metal drum such as of aluminum, copper, iron, zinc or nickel; a sheet-shaped substrate such as paper, plastic or glass evaporated thereon with a metal such as aluminum, copper, gold, silver, platinum, palladium, titanium, nickel-chromium, stainless steel, or copper-indium; the aforementioned substrate evaporated thereon with a conductive metal compound such as indium oxide or tin oxide; the aforementioned substrate laminated with a metal foil; or the aforementioned substrate rendered conductive by dispersing carbon black, indium oxide, tin oxide-antimony oxide powder, metal powder, copper iodide, etc. in a binder resin and coating on such substrate. The conductive substrate 2 may have a shape of a drum, a sheet or a plate.

In the case where a metal pipe substrate is employed as the conductive substrate 2, the surface of such substrate may be untreated, or may be subjected in advance to a treatment such as mirror surface grinding, etching, anodizing, rough cutting, centerless grinding, sand blasting, wet honing, or coloring. Roughing of the substrate surface allows to prevent density speckles of a wood grain-like pattern that can be generated by an optical interference in the photoreceptor in the case of employing a coherent light source.

The undercoat layer 4 serves to prevent a charge injection from the substrate 2 to the photosensitive layer 3 at the charging of the photosensitive layer 3 having a laminar structure, and also as an adhesion layer for integrally adhering and supporting the photosensitive layer 3 on the substrate 2. Also in certain cases, the undercoat layer 4 has a function of preventing light reflection from the substrate 2.

Examples of a material constituting the undercoat layer 4 include a polymer resin compound such as an acetal resin (e.g., polyvinyl butyral), a polyvinyl alcohol resin, casein, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol-formaldehyde resin, or a melamine resin; a zirconium chelate compound, a titanium chelate compound, an aluminum chelate compound, an aluminum alkoxide compound, an organic titanium compound, and a silane coupling agent. There can also be utilized a charge transporting resin having a charge transporting group or a conductive resin such as polyaniline. Such compounds may be employed singly or a mixture or a polycondensate of plural compounds. Among these, there is preferably employed a resin insoluble in a coating liquid for forming an upper layer (for example charge generation layer 5), such as a phenol-formaldehyde resin, a melamine resin, an urethane resin, or an epoxy resin. Also a zirconium chelate compound and a silane coupling agent show superior performances such as a lower retentive potential, a small potential change by environmental conditions, and a small potential change in repeated use.

Examples of the silane coupling agent include vinyl trimethoxysilane, γ-methacryloxypropyl-tris(β-methoxyethoxy)silane, β-(3,4-epoxycyclohexyl)ethyl trimethoxysilane, γ-glycidoxypropyl trimethoxysilane, vinyl triacetoxysilane, γ-mercaptopropyl trimethoxysilane, γ-aminopropyl triethoxysilane, N-β-(aminoethyl)-γ-aminopropyl trimethoxysilane, N-β-(aminoethyl)-γ-aminopropylmethyl methoxysilane, N,N-bis(β-hydroxyethyl)-γ-aminopropyl triethoxysilane, and γ-chloropropyl trimethoxysilane. Among these, particularly preferred silane coupling agents include vinyl triethoxysilane, vinyltris(2-methoxyethoxysilane), 3-methacryloxypropyl trimethoxysilane, 3-glycidoxypropyl trimethoxysilane, 2-(3,4-epoxycyclohexyl)ethyl trimethoxysilane, N-2-(aminoethyl)-3-aminopropyl trimethoxysilane, N-2-(aminoethyl)-3-aminopropylmethyl dimethoxysilane, 3-aminopropyl triethoxysilane, N-phenyl-3-aminopropyl trimethoxysilane, 3-mercaptopropyl trimethoxysilane and 3-chloropropyl trimethoxysilane.

Examples of the zirconium chelate compound include zirconium butoxide, ethyl zirconium acetoacenate, zirconium triethanolamine, acetylacetonate zirconium butoxide, ethyl acetoacetonate zirconium butoxide, zirconium acetate, zirconium oxalate, zirconium lactate, zirconium phosphonate, zirconium octanoate, zirconium naphthenoate, zirconium laurate, zirconium stearate, zirconium isostearate, methacrylate zirconium butoxide, stearate zirconium butoxide and isostearate zirconium butoxide.

Examples of the titanium chelate compound include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolamine and polyhydroxytitanium stearate.

Examples of the aluminum chelate compound include aluminum isopropylate, monobutoxy aluminum diisopropylate, aluminum butylate, diethylacetoacetate aluminum diisopropylate, and aluminum tris(ethylacetoacetate).

In the undercoat layer 4, in order to improve the characteristics of the photoreceptor, there may be included a conductive substance. The conductive substance can be a metal oxide such as titanium oxide, zinc oxide or tin oxide, but there may be employed any known substance as long as desired photosensitive characteristics can be obtained.

Such metal oxide may be subjected to a surface treatment. Such surface treatment can achieve a control of the resistance, a control of the dispersibility and an improvement in the characteristics of the photoreceptor. As the surface treating agent, there can be employed a known material such as a zirconium chelate compound, a titanium chelate compound, an aluminum chelate compound, a titanium alkoxide compound, an organic titanium compound or a silane coupling agent. Such compounds may be employed singly or as a mixture or a polycondensate of plural kinds. Among these, the silane coupling agent is superior in performance such as a low retentive potential, little potential change by environment, little potential change in repeated use and excellent in image quality.

Examples of the silane coupling agent, zirconium chelate compound, titanium chelate compound, and aluminum chelate compound are same as those explained in the foregoing.

The surface treatment can be executed by any known method, but there can be employed a dry method or a wet method.

In the case of a surface treatment with a dry method, a uniform surface treatment can be achieved by agitating fine particles of a metal oxide for example with a mixer of a high shearing force and dripping a silane coupling agent directly or as a solution in an organic solvent, and spraying an obtained mixture with dried air or nitrogen gas. The dripping of the silane coupling agent and the spraying of the mixture is preferably executed at a temperature lower than the boiling point of the solvent. In the case where the dripping or the spraying is executed at or higher than the boiling point of the solvent, the solvent evaporates before a uniform agitation is attained, whereby the silane coupling agent coagulates locally and a uniform processing becomes difficult to achieve.

The metal oxide particles thus employed for surface treatment can be further baked at 100° C. or higher. The baking can be executed within an arbitrary range of temperature and time providing desired electrophotographic characteristics. Also a uniform surface treatment by a wet method can be executed by dispersing fine particles of a metal oxide in a solvent with an agitator, an ultrasonic disperser, a sand mill, an attritor, or a ball mill, then adding and agitating or dispersing a solution of a silane coupling agent and eliminating the solvent. The elimination of the solvent is preferably executed by distillation. An elimination by filtration is undesirable since the unreacted silane coupling agent tends to flow out so that it is difficult to control the amount of the silane coupling agent for obtaining desired characteristics. After the elimination of the solvent, a baking may be executed at 100° C. or higher. The baking can be executed within an arbitrary range of temperature and time providing desired electrophotographic characteristics. In the wet method, for eliminating moisture contained in the metal oxide particles, there can be employed a method of elimination by heating under agitation in a solution to be employed in the surface treatment, or a method of azeotropic elimination with the solvent.

With respect to the metal oxide particles in the undercoat layer 4, the silane coupling agent can be employed in any amount as long as desired electrophotographic characteristics can be obtained. Also in the undercoat layer 4, the metal oxide particles and the resin can be employed in any proportion as long as desired electrophotographic characteristics can be obtained.

In the undercoat layer 4, for example for improving a light scattering property, there can be mixed various organic or inorganic fine powders. Preferred examples of such fine powder include a white pigment such as titanium oxide, zinc oxide, zinc sulfide, lead white or lithopone, an inorganic pigment such as alumina, calcium carbonate or barium sulfate, and particles of a teflon resin, a benzoguanamine resin or a styrene resin. Such fine powder preferably has a particle size of 0.01 to 2 μm. The fine powder is a component added when necessitated, and the amount of addition thereof with respect to a solid contained in the undercoat layer 4 is 10 to 80 wt. % in weight ratio, more preferably 30 to 70 wt. %.

Also in a coating liquid to be employed for forming the undercoat layer 4, there may be employed various additives for improving electrical characteristics, environmental stability and image quality. Such additives include an electron transporting substance for example a quinone compound such as chloranil, bromanil or anthraquinone, a tetracyanoquinodimethane compound, a fluorenone compound such as 2,4,7-trifluorofluorenone or 2,4,5,7-tetranitro-9-fluorenone, an oxadiazole compound such as 2-(4-biphenyl)-5-(4-t-butylphenyl)-1,3,4-oxadiazole, 2,5-bis(4-naphthyl)-1,3,4-oxadiazole, or 2,5-bis(4-diethylaminophenyl)-1,3,4-oxadiazole, a xanthone compound, a thiophene compound or a diphenoquinone compound such as 3,3',5,5'-tetra-t-butyldiphenoquinone, or an electron transporting pigment for example a condensed polycyclic compound or an azo compound.

In the preparation of the coating liquid for forming the undercoat layer, for mixing fine powder of the aforementioned conductive substance or light scattering substance, it is preferred to execute a dispersing process by adding the fine powder to a solution in which a resin component is dissolved. For dispersing the fine powder in the resin, there can be utilized a roll mill, a ball mill, a vibrating ball mill, an attritor, a sand mill, a colloid mill or a paint shaker.

Also for coating the coating liquid for forming the undercoat layer, there can be utilized an ordinary method such as blade coating, wire bar coating, spray coating, dip coating, bead coating, air knife coating or curtain coating.

The undercoat layer 4 has a thickness preferably of 0.01 to 50 μm, more preferably 0.05 to 30 μm.

The charge generating layer 5 is constituted by including a charge generating material and a binder resin. Such charge generating material is at least one selected from hydroxygallium phthalocyanine, chlorogallium phthalocyanine, oxytitanium phthalocyanine, and a trisazo pigment. Such charge generating material can sufficiently increase the sensitivity of the electrophotographic photoreceptor 12 and the environmental stability thereof, so that, even in the case where the electrostatic latent image includes areas with different numbers of light beam irradiations, the density of the image can be made sufficiently uniform. Among such charge generating materials, it is preferred to employ at least one selected from hydroxygallium phthalocyanine, chlorogallium phthalocyanine and a trisazo pigment, and it is particularly preferred to employ following charge generating materials:

(i) hydroxygallium phthalocyanine having diffraction peaks at least at 7.6° and 28.2° in terms of the Bragg angle (2θ±0.2°) of an X-ray diffraction spectrum using CuKα radiation;

(ii) chlorogallium phthalocyanine having diffraction peaks at least at 7.4°, 16.6°, 25.5° and 28.3° in terms of the Bragg angle (2θ±0.2°) of an X-ray diffraction spectrum using CuKα radiation;

(iii) a trisazo pigment represented by a general formula (1);

(iv) a trisazo pigment represented by a general formula (2);

(v) a trisazo pigment represented by a general formula (3); and (vi) a trisazo pigment represented by a general formula (4).

(1)

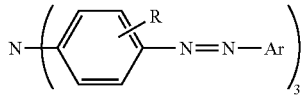

(2)

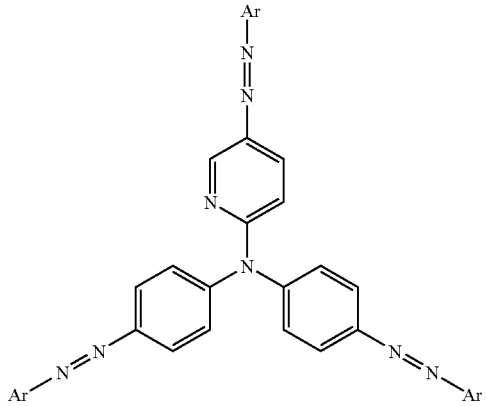

(3)

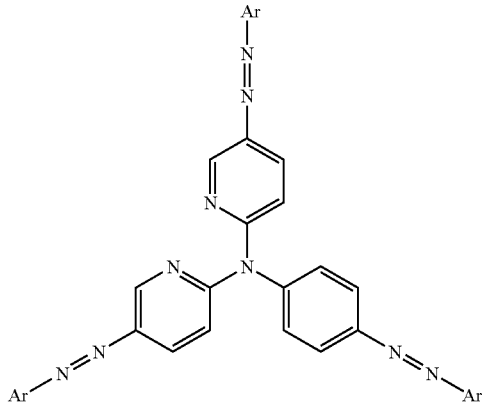

(4)

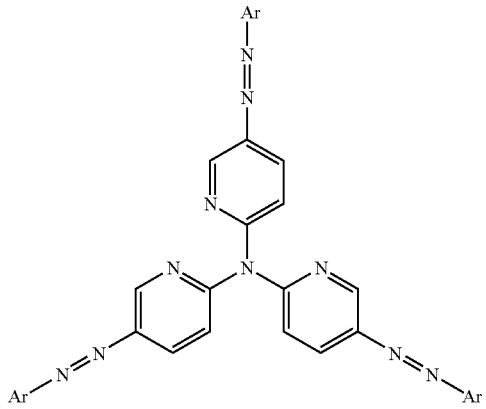

wherein, in the formulas (1) to (4), R represents a hydrogen atom, a halogen atom, an alkyl group, an alkoxy group or a cyano group.

Also Ar represents a coupler residue. Preferred examples of the coupler residue include groups represented by following general formulas (5) to (11):

(5)

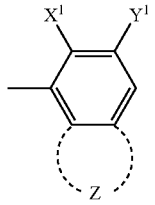

(wherein $X^1$ represents —OH, —N($R^2$) ($R^3$) or —$NHSO_2$—$R^4$ ($R^2$ and $R^3$ each independently represents a hydrogen atom, an acyl group, or a substituted or unsubstituted alkyl group; $R^4$ represents a substituted or unsubstituted alkyl group or a substituted or an unsubstituted aryl group); $Y^1$ represents a hydrogen atom, a halogen atom, a substituted or unsubstituted alkyl group, an alkoxy group, a carboxy group, a sulfon group, a benzimidazolyl group, a substituted or unsubstituted sulfamoyl group, a substituted or unsubstituted allophanoyl group or —CON($R^5$)($Y^2$) ($R^5$ represents a hydrogen atom, an alkyl group or a substituted body thereof, or a phenyl group or a substituted body thereof; and $Y^2$ represents a cyclic hydrocarbon group or a substituted body thereof, a heterocyclic group or a substituted body thereof, or —N═C($R^6$)($R^7$) ($R^6$ represents a cyclic hydrocarbon group or a substituted body thereof; and $R^7$ represents a hydrogen atom, an alkyl group or a substituted body thereof, or a phenyl group or a substituted body thereof; but $R^6$ and $R^7$ may form a ring together with carbon atoms connected thereto)); and Z represents a cyclic hydrocarbon group or a substituted body thereof or a heterocyclic group or a substituted body thereof);

(6)

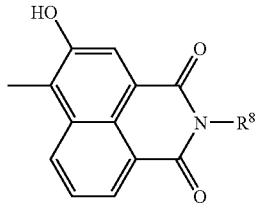

(wherein $R^8$ represents a substituted or unsubstituted hydrocarbon group);

(7)

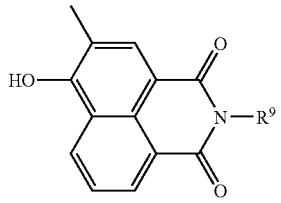

(wherein $R^9$ represents a substituted or unsubstituted hydrocarbon group);

(8)

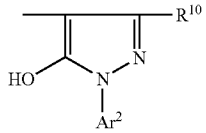

(wherein $R^{10}$ represents an alkyl group, a carbamoyl group, a carboxyl group or an ester thereof; and $Ar^2$ represents a substituted or unsubstituted aromatic hydrocarbon group);

(9)

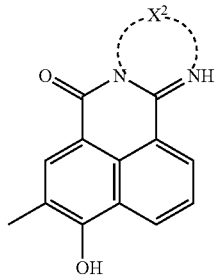

(wherein $X^2$ represents a divalent aromatic hydrocarbon group or a divalent heterocyclic group);

(10)

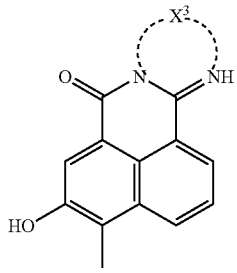

(wherein $X^3$ represents a divalent aromatic hydrocarbon group or a divalent heterocyclic group); and (11)

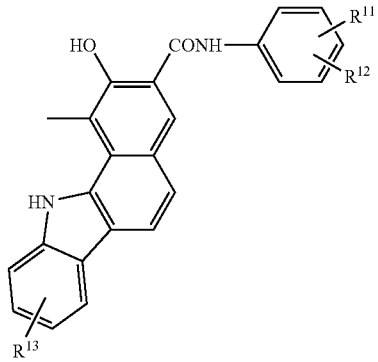

(wherein $R^{11}$ and $R^{12}$, which may be same or different, each independently represents a hydrogen atom, a halogen atom, an alkyl group or an alkoxy group; and $R^{13}$ represents a hydrogen atom or a halogen atom).

The charge generating material to be employed in the invention can be prepared, for example, by a method of crushing pigment crystals, prepared in a known method, by dry crushing with an automatic mortar, a planetary mill, a vibration mill, a CF mill, a roller mill, a sand mill or a kneader, or by wet crushing with a ball mill, a mortar, a sand mill or a kneader together with a solvent after dry crushing.

The solvent to be employed in the aforementioned process can be, for example, an aromatic solvent (toluene, chlorobenzene, etc.), an amide (dimethylformamide, N-methylpyrrolidone, etc.), an aliphatic alcohol (methanol, ethanol, butanol, etc.), an aliphatic polyhydric alcohol (ethylene glycol, glycerin, polyethylene glycol, etc.), an aromatic alcohol (benzyl alcohol, phenetyl alcohol, etc.), an ester (an acetate ester, butyl acetate, etc.), a ketone (acetone, methyl ethyl ketone, etc.), dimethyl sulfoxide, an ether (diethyl ether, tetrahydrofuran, etc.), a mixed solvent of two or more of the foregoing solvents, or a mixed solvent of the foregoing solvent and water. The amount of use of the solvent is preferably 1 to 200 parts by weight with respect to 1 part by weight of the pigment crystals, more preferably 10 to 100 parts by weight. A process temperature is preferably from 0° C. to a boiling point of the solvent, more preferably 10 to 60° C.

At the crushing, there may be employed an auxiliary crushing agent such as salt or sodium sulfate. The amount of the auxiliary crushing agent is preferably 0.5 to 20 times in a weight ratio to the pigment crystals, more preferably 1 to 10 times.

Also the pigment crystals, prepared by a known method, may be controlled by an acid pasting or by a combination of an acid pasting and the aforementioned dry or wet crushing. An acid to be employed in the acid pasting is preferably sulfuric acid, having a concentration of 70 to 100%, preferably 95 to 100%. A dissolving temperature is preferably from −20 to 100° C., more preferably 0 to 60° C. The amount of sulfuric acid is preferably 1 to 100 times in a weight ratio to the pigment crystals, more preferably 3 to 50 times. A solvent for precipitating the pigment crystals dissolved in sulfuric acid can be water or a mixed solvent of water and an organic solvent. Such solvent may be employed in an arbitrary amount. Also a temperature for precipitating the pigment crystals is not particularly restricted, but it is preferred to execute cooling with ice, etc. in order to prevent heat generation.

The charge generating material can be subjected to a surface treatment for improving stability of electrical characteristics and for preventing a defect in the image quality. As a surface treating agent, there can be employed a coupling agent, an organic zirconium compound, an organic titanium compound, or an organic aluminum compound.

Examples of the coupling agent include a silane coupling agent, such as vinyl trimethoxysilane, γ-methacryloxypropyl-tris(β-methoxyethoxy)silane, β-(3,4-epoxycyclohexyl) ethyl trimethoxysilane, γ-glycidoxypropyl trimethoxysilane, vinyl triacetoxysilane, γ-mercaptopropyl trimethoxysilane, γ-aminopropyl triethoxysilane, N-β-(aminoethyl)-γ-aminopropylmethyl methoxysilane, N,N-bis(β-hydroxyethyl)-γ-aminopropyl triethoxysilane, or γ-chloropropyl trimethoxysilane. Among these, particularly preferred is vinyl triethoxysilane, vinyl tris(2-methoxyethoxysilane), 3-methacryloxypropyl trimethoxysilane, 3-glycidoxypropyl trimethoxysilane, 2-(3,4-epoxycyclohexyl)ethyl trimethoxysilane, N-2-(aminoethyl)-3-aminopropyl trimethoxysilane, N-2-(aminoethyl)-3-aminopropylmethyl dimethoxysilane, 3-aminopropyl triethoxysilane, N-phenyl-3-aminopropyl trimethoxysilane, 3-mercaptopropyl trimethoxysilane, or 3-chloropropyl trimethoxysilane.

Also examples of the organic zirconium compound include zirconium butoxide, ethyl zirconium acetoacetate, zirconium triethanolamine, acetyl acetonate zirconium butoxide, ethyl acetoacetate zirconiumbutoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide or isostearate zirconium butoxide.

Examples of the organic titanium compound include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolamine and polyhydroxytitanium stearate.

Also examples of the organic aluminum compound include aluminum isopropylate, monobutoxy aluminum diisopropylate, aluminum butylate, diethylacetoacetate aluminum diisopropylate, and aluminum tris(ethylacetoacetate).

The binder resin to be employed in the charge generating layer 5 can be selected from a wide range of binder resins. It can also be selected from organic photoconductive polymers such as poly-N-vinylcarbazole, polyvinylanthracene, polyvinylpyrene or polysilane. Preferred examples of the binder resin include insulating resins such as polyvinylacetal resin, polyarylate resin (polycondensate of bisphenol-A and phthalic acid, etc.), polycarbonate resin, polyester resin, phenoxy resin, vinyl chloride-vinyl acetate copolymer, polyamide resin, acrylic resin, polyacrylamide resin, polyvinylpyridine resin, cellulose resin, urethane resin, epoxy resin, casein, polyvinylalcohol resin, and polyvinylpyrrolidone resin, but such examples are not exhaustive. Such binder resins can be employed singly or in a mixture of two or more kinds. Among these, particularly preferred is polyvinylacetal resin. A composition ratio (weight ratio) of the charge generating substance and the binder resin is preferably within a range from 10:1 to 1:10.

The charge generating layer 5 is formed with a coating liquid, prepared by adding the charge generating material and the binder resin, specified in the foregoing, in the predetermined solvent. In the preparation of the coating liquid for the charge generating layer, there can be employed a dispersing method with a ball mill, an attritor, or a sand mill. In such dispersion, it is effective to bring the average particle size of the charge generating material preferably to 0.5 μm or less, more preferably 0.3 μm or less and further preferably 0.15 μm or less.

It is also possible to execute a centrifuging process or a filtering process after the dispersion, for eliminating foreign substances mixed at the dispersion or insufficiently dispersed coarse particles and obtaining a satisfactory electrophotographic photoreceptor.

The centrifuging process or the filtering process may be executed under any condition as long as a desired electrophotographic photoreceptor can be obtained, but it is necessary to pay attention so as not to eliminate the necessary charge generating material.

Also in forming the charge generating layer, there can be employed an ordinary coating method such as blade coating, wire bar coating, spray coating, dip coating, bead coating, air knife coating, or curtain coating.

Also for improving the electrical characteristics of the charge generating layer or the image quality, various additives may be added to the coating liquid for forming the charge generating layer. Such additives include an electron transporting substance for example a quinone compound such as chloranil, bromanil or anthraquinone, a tetracyanoquinodimethane compound, a fluorenone compound such as 2,4,7-trifluorofluorenone or 2,4,5,7-tetranitro-9-fluorenone, an oxadiazole compound such as 2-(4-biphenyl)-5-(4-t-butylphenyl)-1,3,4-oxadiazole, 2,5-bis(4-naphthyl)-1,3,4-oxadiazole, or 2,5-bis(4-diethylaminophenyl)-1,3,4-oxadiazole, a xanthone compound, a thiophene compound or a diphenoquinone compound such as 3,3',5,5'-tetra-t-butyldiphenoquinone, or an electron transporting pigment for example a condensed polycyclic compound or an azo compound, a zirconium chelate compound, a titanium chelate compound, an aluminum chelate compound, a titanium alkoxide compound, an organic titanium compound, or a silane coupling agent.

Examples of the silane coupling agent include vinyl trimethoxysilane, γ-methacryloxypropyl-tris (β-methoxyethoxy)silane, β-(3,4-epoxycyclohexyl)ethyl trimethoxysilane, γ-glycidoxypropyl trimethoxysilane, vinyl triacetoxysilane, γ-mercaptopropyl trimethoxysilane, γ-aminopropyl triethoxysilane, N-β-(aminoethyl)-γ-aminopropyl trimethoxysilane, N-β-(aminoethyl)-γ-aminopropylmethyl methoxysilane, N,N-bis(β-hydroxyethyl)-γ-aminopropyl triethoxysilane, and γ-chloropropyl trimethoxysilane.

Examples of the zirconium chelate compound include zirconium butoxide, ethyl zirconium acetoacenate, zirconium triethanolamine, acetylacetonate zirconium butoxide, ethyl acetoacetonate zirconium butoxide, zirconium acetate, zirconium oxalate, zirconium lactate, zirconium phosphonate, zirconium octanoate, zirconium naphthenoate, zirconium laurate, zirconium stearate, zirconium isostearate, methacrylate zirconium butoxide, stearate zirconium butoxide and isostearate zirconium butoxide.

Examples of the titanium chelate compound include tetraisopropyl titanate, tetra-n-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolamine and polyhydroxytitanium stearate.

Examples of the aluminum chelate compound include aluminum isopropylate, monobutoxy aluminum diisopropylate, aluminum butylate, diethylacetoacetate aluminum diisopropylate, and aluminum tris(ethylacetoacetate).

These compounds may be employed singly or as a mixture or a polycondensate of plural compounds.

The charge transport layer 6 is constituted by including a charge transport material and a binder resin. Examples of such charge transport material to be employed in the charge transport layer 6 include an electron transporting substance for example an oxadiazole derivative such as 2,5-bis(p-diethylaminophenyl)-1,3,4-oxadiazole, a pyrazoline derivative such as 1,3,5-triphenylpyrazoline, or 1-[pyridyl-(2)]-3-(p-diethylaminostyryl)-5-(p-diethylaminostyryl)pyrazoline, an aromatic tertiary amino compound such as triphenylamine, tri(p-methylphenyl)amine, N,N'-bis(3,4-dimethylphenyl)biphenyl-4-amine, dibenzylaniline, or 9,9-dimethyl-N,N'-di(p-tolyl)fluorenone-2-amine, an aromatic tertiary diamino compound such as N,N'-diphenyl-N,N'-bis(3-methylphenyl)-[1,1-biphenyl]-4,4'-diamine, a 1,2,4-triazine derivative such as 3-(4,4'-dimethylaminophenyl)-5,6-di-(4,4'-methoxyphenyl)-1,2,4-triazine, a hydrazone derivative such as 4-diethylaminobenzaldehyde-1,1-diphenylhydrazone, 4-diphenylaminobenzaldehyde-1,1-diphenylhydrazone, or [p-(diethylamino)phenyl]-(1-naphthyl)hydrazone, a quinazoline derivative such as 2-phenyl-4-styrylquinazoline, a benzofuran derivative such as 6-hydroxy-2,3-di(p-methoxyphenyl)-benzofuran, an α-stilbene derivative such as p-(2,2-diphenylvinyl)-N,N'-diphenylaniline, an enamine derivative, a carbazole derivative such as N-ethylcarbazole, poly-N-vinylcarbazole and a derivative thereof; and an electron transporting substance for example chloranil, bromanil, a quinone compound such as anthraquinone, a tetracyanoquinodimethane compound, a fluorenone compound such as 2,4,7-trifluorofluorenone or 2,4,5,7-tetranitro-9-fluorenone, an oxadiazole compound such as 2-(4-biphenyl)-5-(4-t-butylphenyl)-1,3,4-oxadiazole, 2,5-bis(4-naphthyl)-1,3,4-oxadiazole, or 2,5-bis(4-diethylaminophenyl)-1,3,4-oxadiazole, a xanthone compound, a thiophene compound or a diphenoquinone compound such as 3,3',5,5'-tetra-t-butyldiphenoquinone; and a polymer having a group of a structure similar to the foregoing compounds in a main chain or in a side chain. Such charge transport materials can be employed singly or in a combination of two or more kinds.

The binder resin to be employed in the charge transport layer 6 is not particularly limited, but there is preferred a resin which is electrically insulating and is capable of forming a film. Examples of such binder resin include polycarbonate resin, polyester resin, methacrylic resin, acrylic resin, polyvinyl chloride resin, polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, silicone resin, silicone-alkyd resin, phenol-formaldehyde resin, styrene-alkyd resin, poly-N-carbazole, polyvinylbutyral, polyvinylformal, polysulfon, casein, gelatin, polyvinyl alcohol, ethyl cellulose, phenolic resin, polyamide, carboxymethyl cellulose, vinylidene chloride polymer wax, and polyurethane. Among these, polycarbonate resin, polyester resin, methacrylic resin, and acrylic resin are superior in a mutual solubility with the charge transport material, a solubility in the solvent and a strength, and can be advantageously employed. These binder resins can be employed singly or in a combination of two or more kinds. A composition ratio (weight ratio) of the binder resin and the charge transport material can be arbitrarily selected, but is preferably from 70:30 to 40:60.

The charge transport layer 6 can be formed by coating a coating liquid, prepared by adding the charge transport substance and the binder resin in a predetermined solvent, on the charge generating layer 5, followed by drying. For coating, there can be employed an ordinary coating method such as blade coating, wire bar coating, spray coating, dip coating, bead coating, air knife coating or curtain coating. The solvent to be employed in the coating liquid can be an ordinary organic solvent, such as dioxane, tetrahydrofuran, methylene chloride, chloroform, chlorobenzene or toluene, which can be employed singly or in a mixture of two or more kinds.

The charge transport layer 6 preferably has a thickness of 5 to 50 μm, more preferably 10 to 35 μm, for suppressing a loss in the electrical characteristics and in the film strength.

The charge transport layer 6 has a charge mobility, for enabling use at a high speed and suppressing a stripe-shaped density unevenness, preferably $1.0\times10^{-6}$ $cm^2/V\cdot s$ or higher, more preferably $5.0\times10^{-6}$ $cm^2/V\cdot s$ or higher, and further preferably $1.0\times10^{-5}$ $cm^2/V\cdot s$ or higher.

Also in the electrophotographic photoreceptor of the invention, in order to prevent a deterioration of the photoreceptor by ozone or an oxidative gas generated in the electrophotographic apparatus or by light or heat, an additive such as an antioxidant, a stabilizer to light or a stabilizer to heat may be added to the photosensitive layer.

Examples of the antioxidant include a hindered phenol, a hindered amine, paraphenylene diamine, an arylalkane, hydroquinone, spirochroman, spiroindanone and derivatives thereof, an organic sulfur compound and an organic phosphor compound.

Examples of phenolic antioxidant include 2,6-di-t-butyl-4-methylphenol, stylenized phenol, n-octadecyl-3-(3',5'-di-t-butyl-4'-hydroxyphenyl) propionate, 2,2'-methylene-bis-(4-methyl-6-t-butylphenyl), 2-t-butyl-6-(3'-t-butyl-5'-methyl-2'-hydroxybenzyl)-4-methylphenyl acrylate, 4,4'-butylidene-bis(3-methyl-6-t-butylphenol), 4,4'-thio-bis(3-methyl-6-t-butylphenol), 1,3,5-tris(4-t-butyl-3-hydroxy-2,6-dimethylbenzyl) isocyanurate, tetraquis[methylene-3-(3',5'-di-t-butyl-4'-hydroxyphenyl) propionate]-methane, and 3,9-bis[2-[3-(3-t-butyl-4-hydroxy-5-methylphenyl) propionyloxy]-1,1-dimethyethyl]-2,4,8,10-tetraoxaspiro[5,5]undecane.

Examples of the hindered amine compound include bis (2,2,6,6-tetramethyl-4-piperidyl) sebacate, bis(1,2,2,6,6-pentamethyl-4-piperidyl) sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpiperidine, 8-benzyl-7,7,9,9-tetramethyl-3-octyl-1,3,8-triazaspiro[4,5]undecane-2,4-dione, 4-benzoyloxy-2,2,6,6-tetramethylpiperidine, dimethyl succinate-1-(2-hydroxyethyl)-4-hydroxy-2,2,6,6-tetramethylpiperidine polycondensate, poly[{6-(1,1,3,3-tetramethylbutyl) imino-1,3,5-triazine-2,4-diimyl}{(2,2,6,6-tetramethyl-4-piperidyl)imino}hexa-methylene{(2,3,6,6-tetramethyl-4-piperidyl)imino}], 2-(3,5-di-t-butyl-4-hydroxybenzyl)-2-n-butyl malonate bis(1,2,2,6,6-pentamethyl-4-piperidyl), and N,N'-bis(3-aminopropyl)ethylenediamine-2,4-bis[N-butyl-N-(1,2,2,6,6-pentamethyl-4-piperidyl)amino]-6-chloro-1,3,5-triazine condensate.

Examples of the organic sulfur-containing antioxidant include dilauryl-3,3'-thiodipropionate, dimyristyl-3,3'-thiodipropionate, distearyl-3,3'-thiodipropionate, pentaerythritol-tetraquis(β-laurylthiopropionate), ditridecyl-3,3'-thiodipropionate, and 2-mercaptobenzimidazole.

Examples of the organic phosphor-containing antioxidant include trisnonylphenyl phosphite, triphenyl phosphite, and tris(2,4-di-t-butylphenyl) phosphite.

The organic sulfur-containing antioxidant or the organic phosphor-containing antioxidant is called a secondary antioxidant, and can obtained a multiplying effect by a combined use with a primary antioxidant such as a phenolic antioxidant or an amine antioxidant.

The light stabilizer can be a derivative of benzophenone, benzotriazole, dithiocarbamate or tetramethylpiperidine.

Examples of the benzophenone light stabilizer include 2-hydroxy-4-methoxybenzophenone, 2-hydroxy-4-octoxybenzophenone, and 2,2'-dihydroxy-4-methoxybenzophenone.

Examples of the benzotriazole light stabilizer include 2-(2'-hydroxy-5'-methylphenyl)benzotriazole, 2-[2'-hydroxy-3'-(3",4",5",6"-tetrahydrophthalimidmethyl)-5'-methylphenyl]benzotriazole, 2-(2'-hydroxy-3'-t-butyl-5'-methylphenyl)-5-chlorobenzotriazole, 2-(2'-hydroxy-3'-t-butyl-5'-methylphenyl)-5-chlorobenzotriazole, 2-(2'-hydroxy-3',5'-di-t-butylphenyl)benzotriazole, 2-(2'-hydroxy-5'-t-octylphenyl)benzotriazole, and 2-(2'-hydroxy-3',5'-di-t-amylphenyl)benzotriazole.

There can also be employed other compounds such as 2,4-di-t-butylphenyl-3',5'-di-t-butyl-4'-hydroxy benzoate and nickel dibutyldithiocarbamate.

Also for the purposes of improving the sensitivity, reducing the residual potential and decreasing a fatigue in the repeated use, there may be included at least one electron accepting substance. Examples of the electron accepting substance usable in the electrophotographic photoreceptor of the invention include succinic anhydride, maleic anhydride, dibromosuccinic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, -nitrobenzoic acid, and phthalic acid. Among these, particularly preferred is a fluorenone compound, a quinone compound or a benzene derivative having an electron attracting substituent such as Cl, CN or $NO_2$.

In the coating liquid, there can also be added a small amount of silicone oil as a leveling agent for improving the smoothness of the coated film.

The electrophotographic photoreceptor of the invention may be provided with a protective layer 7 if necessary. Presence of the protective layer 7 allows, in the electrophotographic photoreceptor of a laminar structure, to prevent a chemical change in the charge transport layer 6 or to improve the mechanical strength of the photosensitive layer 3. Such protective layer 7 is formed by including for example a conductive material in a suitable binder resin.

Examples of the conductive material to be used in the protective layer 7 include a metallocene compound such as N,N'-dimethylferrocene, an aromatic amine compound such as N,N'-diphenyl-N,N'-bis(3-methylphenyl)-[1,1'-biphenyl]-4,4'-diamine, molybdenum oxide, tungsten oxide, antimony oxide, tin oxide, titanium oxide, indium oxide, a powder of a solid solution of tin oxide and antimony or antimony oxide or a mixture thereof, or single particles in which such metal oxide is mixed or coated, but such examples are not exhaustive.

Examples of the binder resin to be used for the protective layer 7 include polyamide resin, polyvinylacetal resin, polyurethane resin, polyester resin, epoxy resin, polyketone resin, polycarbonate resin, polyvinylketone resin, polystyrene resin, polyacrylamide resin, polyimide resin and polyamidimide resin, and such binder resin may be used in a crosslinked state if necessary. It is also possible to use a siloxane resin having a charge transporting property and having a crosslinked structure as the protective layer. In the case of a hardened siloxane resin film containing a charge transporting compound, there can be employed any known charge transporting compound, for example compounds disclosed in JP 10-95787 A, JP 10-251277 A, JP 11-32716 A, JP 11-38656 A and JP 11-236391 A, but such compounds are not restrictive. The hardened siloxane resin film containing the charge transporting compound can be represented by a general formula (I) as a specific example:

$$F\text{-}[D\text{-}SiR^{14}_{3-a}(OR^{15})_a]_b \quad (I)$$

wherein R represents an organic group derived from a photofunctional compound; D represents a divalent group; $R^{14}$ represents a hydrogen atom, an alkyl group or a substituted or unsubstituted aryl group; $R^{15}$ represents a hydrogen atom, an alkyl group or a substituted or unsubstituted aryl group; a represents an integer from 1 to 3; and b represents an integer from 1 to 4.

In the general formula (I), F represents an organic group having photoelectric property, more specifically a photocarrier transporting property, and there can be employed a structure of a photofunctional compound conventionally known as a charge transporting substance. An organic group represented by F can be, more specifically, a skeleton of a compound having a positive hole transporting property such as a triarylamine compound, a benzidine compound, an arylalkane compound, an aryl-substituted ethylenic compound, a stilbene compound, an anthracene compound, a hydrazone compound, or a skeleton of a compound having an electron transporting property such as a quinone compound, a fluorenone compound, a xanthone compound, a benzophenone compound, a cyanovinylic compound or an ethylenic compound.

In the general formula (I), a group represented by $SiR^{14}_{3-a}(OR^{15})_a$ serves to form, by a mutual crosslinking reaction, a three-dimensional Si—O—Si bond, namely an inorganic glassy network.

In the general formula (I), the divalent group represented by D is provided to combine the group F, for providing the charge transporting property, by a direct bonding to the three-dimensional inorganic glassy network. It also serves to provide the inorganic glassy network, which is hard but is also brittle, with a suitable flexibility thereby improving the toughness of the film. Specific examples include a divalent hydrocarbon group such as $—C_nH_{2n}—$, $—C_nH_{2n-2}—$, or $—C_nH_{2n-4}—$ (n being preferably 2 to 15), —COO—, —S—, —O—, $—CH_2—C_6H_4—$, —N═H—, $—C_6H_4—C_6H_4—$, a combination thereof and such group in which a substituent is introduced.

A preferred example of the organic group F is a group represented by the following general formula (II). In the case where F is a group represented by the general formula (II), there are obtained particularly excellent photoelectric characteristics and mechanical characteristics.

(II)

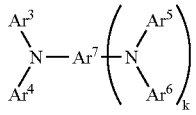

(In the general formula (II), $Ar^2$ to $Ar^6$ each independently represents a substituted or unsubstituted aryl group; $Ar^7$ represents a substituted or unsubstituted aryl or arylene group; k represents 0 or 1; and the number of the groups, among $Ar^3$ to $Ar^7$, having a bonding hand for bonding to a group represented by $-D-SiR^{14}_{3-a}(OR^{15})$ is b.)

In the foregoing general formula (II), each of $Ar^3$ to $Ar^4$ is preferably one of groups represented by following formulas (II-1) to (II-7):

(II-1)

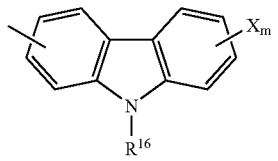

-continued (II-2)

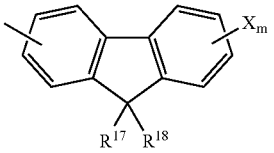

(II-3)

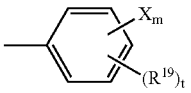

(II-4)

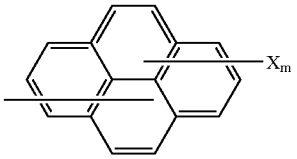

(II-5)

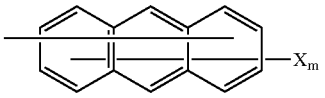

(II-6)

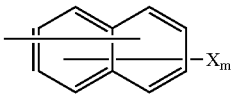

(II-7)

—Ar—$Z'_s$—Ar—$X_m$ (In the formulas, $R^{16}$ represents one selected from the group consisting of an alkyl group having 1 to 4 carbon atoms, a phenyl group substituted with an alkyl group having 1 to 4 carbon atoms or an alkoxy group having 1 to 4 carbon atoms, an unsubstituted phenyl group and an aralkyl group having 7 to 10 carbon atoms; $R^{17}$ to $R^{19}$ each represents one selected from the group consisting of a hydrogen atom, an alkyl group having 1 to 4 carbon atoms, a phenyl group substituted with an alkyl group having 1 to 4 carbon atoms or an alkoxy group having 1 to 4 carbon atoms, an unsubstituted phenyl group, an aralkyl group having 7 to 10 carbon atoms, and a halogen atom; Ar represents a substituted or unsubstituted arylene group; X represents $-D-SiR^{14}_{3-a}(OR^{15})$ in the general formula (I); and t represents an integer from 1 to 3.)

In the formula (II-7), Ar is preferably represented by one of following formula (II-8) and (II-9):

(II-8)

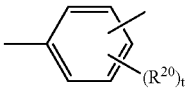

(II-9)

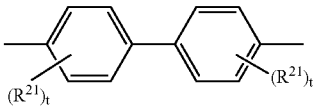

(In the formulas, $R^{10}$ and $R^{11}$ each represents one selected from the group consisting of a hydrogen atom, an alkyl group having 1 to 4 carbon atoms, a phenyl group substituted with an alkyl group having 1 to 4 carbon atoms or an alkoxy group having 1 to 4 carbon atoms, an unsubstituted phenyl group, an aralkyl group having 7 to 10 carbon atoms, and a halogen atom; and t represents an integer from 1 to 3.)

In the formula (II-7), Z' is preferably represented by either one of following formulas (II-10) to (II-17):

(II-10) $—(CH_2)_q—$ (II-11) $—(CH_2CH_2O)_r—$ (II-12)

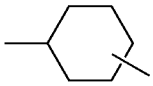

(II-13)

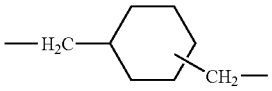

(II-14)

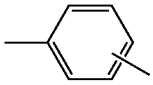

(II-15)

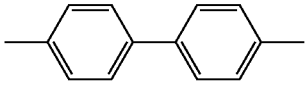

(II-16)

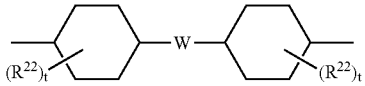

(II-17)

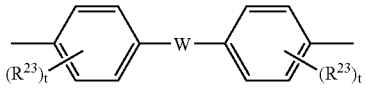

(In the formulas, $R^{22}$ and $R^{23}$ each represents one selected from the group consisting of a hydrogen atom, an alkyl group having 1 to 4 carbon atoms, a phenyl group substituted with an alkyl group having 1 to 4 carbon atoms or an alkoxy group having 1 to 4 carbon atoms, an unsubstituted phenyl group, an aralkyl group having 7 to 10 carbon atoms, and a halogen atom; W represents a divalent group; q and r each represents an integer from 1 to 10; and t represents an integer from 1 to 3.)

In the formulas (II-16) and (II-17), W is preferably either one of divalent groups represented by following formulas (II-18) to (II-26):

(II-18) $—CH_2—$ (II-19) $—C(CH_3)_2—$ (II-20) $—O—$ (II-21) $—S—$ (II-22) $—C(CF_3)_2—$ (II-23) $—Si(CH_3)_2—$ (II-24)

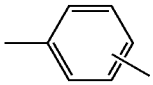

-continued (II-25)

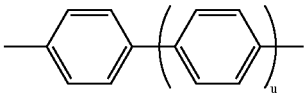

(II-26)

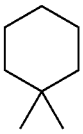

(In the formulas, u represents an integer from 0 to 3.)

In the general formulas (II), $Ar^5$ is an aryl group of which examples are shown for $Ar^1$ to $Ar^4$ in the case where k is 0, and is an arylene group obtained by eliminating a predetermined hydrogen atom from such aryl group in the case where k is 1.

In the general formula (I), a divalent group represented by D serves to combine the group F for providing the photoelectric property and the group A directly connected to the three-dimensional inorganic glassy network, and also serves to provide the inorganic glassy network, which is hard but is also brittle, with a suitable flexibility thereby improving the toughness of the film. Specific examples of the divalent group represented by D include a divalent hydrocarbon group such as $—C_nH_{2n}—$, $—C_nH_{2n-2}—$, or $—C_nH_{2n-4}—$ (n being 1 to 15), —COO—, —S—, —O—, $—CH_2—C_6H_4—$, —N═H—, $—C_6H_4—C_6H_4—$, a combination thereof and such group in which a substituent is introduced.

In the general formula (I), b is preferably 2 or larger. In the case where b is equal to or larger than 2, the photofunctional organic silicon compound represented by the general formula (I) includes two or more Si atoms, thereby facilitating the formation of the inorganic glass network and improving the mechanical strength.

The compound represented by the general formula (I) may be employed singly or in a combination of two or more kinds.

Also, for further improving the mechanical strength of the hardened film, the compound represented by the general formula (I) may be used in combination with a compound represented by the following general formula (III):

$$B(—SiR^{14}_{3-a}(OR^{15})_a)_n \quad \text{(III)}$$

wherein $R^{14}$, $R^{15}$ and a have same definitions as those in the general formula (I); B represents an n-valent group selected from an n-valent hydrocarbon group and —NH—, or constituted by a combination of two or more thereof; and n represents an integer equal to or larger than 2.

In the general formula (III), B represents an n-valent group selected from an n-valent hydrocarbon group and —NH—, or constituted by a combination of two or more thereof as explained above. In the case where B is an n-valent hydrocarbon group or is constituted by including such hydrocarbon group, the hydrocarbon group can be any of an alkyl group, an aryl group, an alkylaryl group and an arylakyl group. Also an alkyl group included in such hydrocarbon group can be linear or ramified. Further, such hydrocarbon group may have a substituent.

The compound represented by the general formula (III) is provided with a substituted silicon group having a hydrolysable group represented by $—SiR^{14}_{3-a}(OR^{15})_a$. The compound represented by the general formula (III) forms, by a reaction with a compound represented by the general formula (I) or with a compound represented by the general formula (III), a Si—O—Si bond thereby providing a threedimensionally crosslinked hardened film. A combined use of the compound represented by the general formula (III) and the compound represented by the general formula (I) facilitates formation of a three-dimensional crosslinked structure in the hardened film and provides the hardened film with a suitable flexibility thereby providing a higher mechanical strength. Preferred examples of the compound represented by the general formula (III) are shown in Table 1.

TABLE 1

| | |
|---|---|
| III-1 | 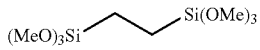 |
| III-2 | 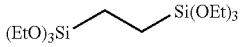 |
| III-3 | 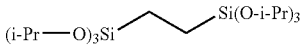 |
| III-4 | 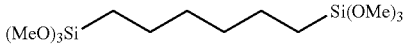 |
| III-5 | 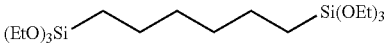 |
| III-6 | 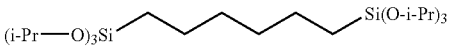 |
| III-7 | 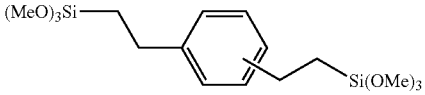 |
| III-8 | 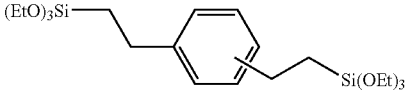 |
| III-9 | 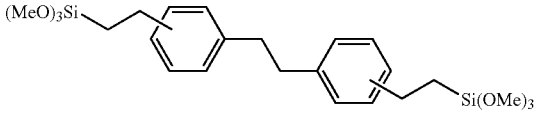 |
| III-10 | 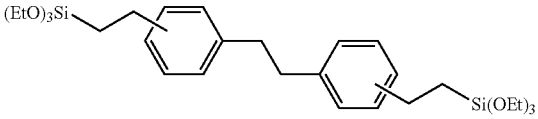 |
| III-11 | 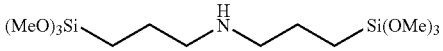 |
| III-12 | 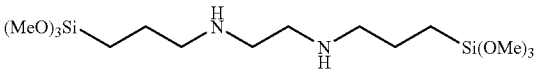 |
| III-13 | $(MeO)_2MeSi(CH_2)_2SiMe(OMe)_2$ |
| III-14 | $(EtO)_2EtSi(CH_2)_2SiEt(OEt)_2$ |
| III-15 | $(MeO)_2MeSi(CH_2)_6SiMe(OMe)_2$ |
| III-16 | $(EtO)_2EtSi(CH_2)_6SiEt(OEt)_2$ |
| III-17 | $(MeO)_2MeSi(CH_2)_{10}SiMe(OMe)_2$ |
| III-18 | $(EtO)_2EtSi(CH_2)_{10}SiEt(OEt)_2$ |
| III-19 | $MeOMe_2Si(CH_2)_6SiMe_2OMe$ |

The compound represented by the general formula (I) may be used singly, or, for regulating a film forming property or a flexibility of the film, in a mixture with the compound represented by the general formula (III), another coupling agent or a fluorinated compound. For such compound, there can be employed various silane coupling agents or commercially available silicone hard coating agents.

Examples of the silane coupling agent include vinyl trichlorosilane, vinyl trimethoxysilane, vinyl triethoxysilane, γ-glycidoxypropylmethyl diethoxysilane, γ-glycidoxypropyl trimethoxysilane, γ-aminopropyl triethoxysilane, γ-aminopropyl trimethoxysilane, γ-aminopropylmethyl dimethoxysilane, N-β-(aminoethyl)-γ-aminopropyl triethoxysilane, tetramethoxysilane, methyl trimethoxysilane and dimethyl dimethoxysilane. Examples of the commercially available hard coating agent include KP-85, X-40-9740, X-40-2239 (foregoing manufactured by Shinetsu Silicone Ltd.), AY42-440, AY42-441, AY49-208 (foregoing manufactured by Toray Dow-Corning Co.). Also, for providing a water-repellent property, etc., there may be added a fluorine-containing compound such as (tridecafluoro-1,1,2,2-tetrahydrooctyl) triethoxysilane, (3,3,3-trifluoropropyl) trimethoxysilane, 3-(heptafluoroisopropoxy)propyl triethoxysilane, 1H,1H,2H,2H-perfluoroalkyl triethoxysilane, 1H,1H,2H,2H-perfluorodecyl triethoxysilane, or 1H,1H,2H,2H-perfluorooctyl triethoxysilane. The silane coupling agent can be employed in an arbitrary amount, but the content of the fluorine-containing compound is preferably 0.25 wt. % or less with respect to compounds not containing fluorine. An exceeding content may cause a difficult in the film forming property of the crosslinked film.

Such coating liquid can be prepared either without a solvent, or with a solvent, if necessary, for example an alcohol such as methanol, ethanol, propanol or butanol; a ketone such as acetone or methyl ethyl ketone; or an ether such as tetrahydrofuran, diethylether or dioxane, and such solvent preferably has a boiling point not exceeding 100° C. and may be employed as an arbitrary mixture. The amount of the solvent may be selected arbitrarily, but, since an excessively small amount of the solvent tends to cause a precipitation of the compound of the general formula (I), is employed in an amount of 0.5 to 30 parts by weight with respect to 1 part by weight of the compound represented by the general formula (I), preferably 1 to 20 parts by weight. A temperature and a time of the reaction are variable depending on the type of the materials, but the reaction is generally executed at a temperature of 0 to 100° C., preferably 10 to 70° C. and particularly preferably 10 to 50° C. A reaction time is not particularly restricted, but is preferably selected within a range from 10 minutes to 100 hours, since a longer reaction time tends to result in gelation.

For preparing the coating liquid, there may be executed hydrolysis in advance, utilizing the following catalyst as a solid catalyst insoluble in the system:

Cation exchange resin: Amberlite 15, Amberlite 200C, Amberlist 15 (foregoing manufactured by Rohm & Haas Co.); Dowex MWC-1-H, Dowex 88, Dowex HCR-W2 (foregoing manufactured by Dow Chemical Co.); Lewatit SPC-108, Lewatit SPC-118 (foregoing manufactured by Bayer Corp.); Diaion RCP-150H (manufactured by Mitsubishi Chemical Corp.); Sumikaion KC-470, Duolite C26-C, Duolite C-433, Duolite-464 (foregoing manufactured by Sumitomo Chemical Co.); Naphion-H (manufactured by E.I. du Pont de Nemeurs Co.), etc.;

Anion exchange resin: Amberlite IRA-400, Amberlite IRA-45 (foregoing manufactured by Rohm & Haas Co.), etc.;

Inorganic solid having a surfacially bonded group having a proton acid group: $Zr(O_3PCH_2CH_2SO_3H)_2$, $Th(O_3PCH_2CH_2COOH)_2$, etc.;

Polyorganosiloxane having a proton acid group: polyorganosiloxane having a sulfonic acid group, etc.;

Heteropoly acid: cobalt-tungstenic acid, phosphor-molybdenic acid, etc.;

Isopoly acid: niobic acid, tantalic acid, molybenic acid, etc.;

Single-element metal oxide: silica gel, alumina, chromia, zirconia, Cao, MgO, etc.;

Complex metal oxide: silica-alumina, silica-magnesia, silica-zirconia, zeolite acid, etc.;

Clay mineral: acid white clay, active white clay, montmorillonite, caolinite, etc.;

Metal sulfate: $LiSO_4$, $MgSO_4$, etc.;

Metal phosphate: zirconium phosphate, lanthanum phosphate, etc.;

Metal nitrate: $LiNO_3$, $Mn(NO_3)_2$, etc.;

Inorganic solid having a surfacially bonded group having an amino group: a solid obtained by reacting aminopropyl triethoxysiline on silica gel, etc.;

Polyorganosiloxane containing amino group: amino-denatured silicone resin, etc.

A hydrolytic condensation reaction is executed with at least one of these catalysts. The reaction may be executed in a flow type with such catalyst set in a fixed bed, or in a batch type. The amount of the catalyst is not particularly restricted, but is preferably 0.1 to 20 wt. % with respect to the total amount of the material having the hydrolysable substituent on silicon.

An addition amount of water at the hydrolytic condensation is not particularly restricted, but, since it affects stability of the product in storage or suppression of gelation in further executing a polymerization, it is preferably employed in a range of 30 to 500% of a theoretical amount required for hydrolyzing all the hydrolysable groups in the compound represented by the general formula (I), more preferably 50 to 300%. A water amount exceeding 500% tends to deteriorate the stability of the product in storage, or to cause a precipitation. On the other hand, a water amount less than 30% increases the amount of the unreacted compound, thereby resulting in a phase separation at the coating or the hardening of the coating liquid or a loss in the strength.

Also as a hardening catalyst, there can be employed a proton acid such as hydrochloric acid, acetic acid, phosphoric acid or sulfuric acid; a base such as ammonia or triethylamine; an organic tin compound such as dibutyl tin diacetate, dibutyl tin dioctoate or stannic octoate; an organic titanium compound such as tetra-n-butyl titanate or tetraisopropyl titanate; an organic aluminum compound such as aluminum tributoxide or aluminum triacetylacetonate; or an iron salt, a manganese salt, a cobalt salt, a zinc salt or a zirconium salt of an organic carboxylic acid. Among these, in consideration of the stability in storage, there is preferred a metal compound, more preferably acetylacetonate or acetylacetate of a metal, and particularly preferably aluminum triacetylacetonate. The amount of use of the hardening catalyst can be arbitrarily selected, but, in consideration of the stability in storage, the characteristics and the strength, it is preferably employed within a range of 0.1 to 20 wt. % with respect to a total amount of the material having the hydrolysable substituent on silicon, more preferably 0.3 to 10 wt. %. A hardening temperature can be selected arbitrarily, but is selected at 60° C. or higher for obtaining a desired strength, more preferably 80° C. or higher. A hardening time can be arbitrarily selected according to the necessity, but is preferably within a range of 10 minutes to 5 hours. It is also effective, after the hardening reaction, to maintain a high humidity state, thereby stabilizing the characteristics. It is also possible, for certain applications, to execute a surface treatment with hexamethylsilazane or trimethylchlorosilane thereby obtaining a hydrophobic surface.

In the crosslinked and hardened surface film of the electrophotographic photoreceptor, it is preferred to add an antioxidant in order to prevent a deterioration by an oxidative gas such as ozone, generated in the charging device. In the case where the mechanical strength of the surface of the electrophotographic photoreceptor is increased to extend the service life thereof, there is required a stronger resistance to oxidation than in the past, as the electrophotographic photoreceptor is exposed to the oxidative gas for a longer period. As the antioxidant, there is preferred a hindered phenol or a hindered amine, and there may be employed a known antioxidant such as an organic sulfur antioxidant, a phosphite antioxidant, a dithiocarbamate antioxidant, a thiourea antioxidant or a benzimidazole antioxidant. The amount of addition of the antioxidant is preferably 20 wt. % or less, more preferably 10 wt. % or less.

Examples of the hindered phenol antioxidant include 2,6-t-butyl-4-methylphenol, 2,5-di-t-butylhydroquinone, N,N'-hexamethylenebis(3,5-di-t-butyl-4-hydroxyhydro-cinnamide), 3,5-di-t-butyl-4-hydroxybenzylphosphonate diethyl ester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenyl acrylate, and 4,4'-butylidenebis(3-methyl-6-t-butylphenol).

It is also possible to add an alcohol-soluble resin for the purposes of controlling a discharge gas resistance, a mechanical strength, a scratch resistance, a particle dispersibility and a viscosity, reducing a torque, controlling an abrasion amount and extending a pot life. Examples of the alcohol-soluble resin include polyvinyl acetal resin such as polyvinyl butyral resin, polyvinyl formal resin or a partially acetalated polyvinyl acetal resin in which a part of butyral is denatured with formal or acetacetal (for example Esrec B, K manufactured by Sekisui Chemicals Co.), polyamide resin, cellulose resin, and phenolic resin. Polyvinyl acetal resin is particularly preferred because of the electrical characteristics. The aforementioned resin preferably has an average molecular weight of 2,000 to 100,000, particularly preferably 5,000 to 50,000. An average molecular weight less than 2,000 is difficult to obtain desired effects. On the other hand, an average molecular weight exceeding 100,000 reduces the solubility, thereby resulting in a limitation in the amount of addition, or a defective film formation at the coating. An addition amount of the resin is preferably 1 to 40 wt. %, more preferably 1 to 30 wt. % and particularly preferably 5 to 20 wt. %. An addition amount of the resin less than 1 wt. % is difficult to obtain desired effects, while an amount exceeding 40 wt. % tends to generate an image blur in an environment of a high temperature and a high humidity.

Also, various fine particles may be added in order to improve a resistance to adhesion of contaminant and a lubricating property of the surface of the electrophotographic photoreceptor. The fine particles may be employed in one kind or in a combination of two or more kinds. An example of the fine particles is silicon-containing fine particles. The silicon-containing fine particles are fine particles including silicon as a constituent element, and more specifically colloidal silica or fine silicone particles. The colloidal silica employed as the silicon-containing fine particles can be selected from an acidic or alkaline aqueous dispersion and a dispersion in an organic solvent such as an alcohol, a ketone or an ether, having an average particle size of 1 to 100 nm, preferably 10 to 30 nm, and there can be utilized a commercially available product. A solid content of the colloidal silica in an outermost layer, though not particularly restricted, is selected in consideration of a film forming property, electrical characteristics and a strength, within a range of 0.1 to 50 wt. % with respect to the total solid in the outermost layer, preferably 0.1 to 30 wt. %.

The fine silicone particles employed as the silicon-containing fine particles are selected from silicone resin particles, silicon rubber particles and silica particles surface treated with silicone, having a spherical shape and an average particle size of 1 to 500 nm, preferably 10 to 100 nm, and there can be employed a commercially available product. The fine silicone particles are small particles which are chemically inert and show excellent dispersibility in resin, and, since only a low content is required for obtaining sufficient characteristics, can improve the surface property of the electrophotographic photoreceptor without hindering the crosslinking reaction. More specifically, such particles, existing uniformly in the strong crosslinked structure, can improve the lubricating property and the water repellent property of the surface of the electrophotographic photoreceptor and can maintain an abrasion resistance and a resistance to contaminant deposition at a satisfactory level over a prolonged period. In the electrophotographic photoreceptor of the invention, the outermost layer has the content of the fine silicone particles within a range of 0.1 to 30 wt. % with respect to the total solid of the outermost layer, preferably 0.5 to 10 wt. %.

Other examples of the fine particles include fluorine-containing particles such as tetrafluoroethylene, trifluoroethylene, hexafluoropropylene, vinyl fluoride and vinylidene fluoride; fine particles of a resin obtained by copolymerizing a fluorinated resin and a monomer containing a hydroxyl group as described in "8th Polymer Material Forum Preprint p.89", and a semi-conductive metal oxide such as ZnO—$Al_2O_3$, SnO—$Sb_2O_3$, $In_2O_3$—$SnO_2$, ZnO—$TiO_2$, MgO—$Al_2O_3$, FeO—$TiO_2$, $TiO_2$, $SnO_2$, $In_2O_3$, ZnO, or MgO. It is also possible to add silicone oil or the like for a similar purpose. For such silicone oil, there can be employed a silicone oil such as dimethyl polysiloxane, diphenyl polysiloxane, or phenylmethylsiloxane; a reactive silicone oil such as amino-denatured polysiloxane, epoxy-denatured polysiloxane, carboxyl-denatured polysiloxane, carbinol-denatured polysiloxane, methacryl-denatured polysiloxane, mercapto-denatured polysiloxane, or phenol-denatured polysiloxane; and a cyclic siloxane for example a cyclic dimethylcyclosiloxane such as hexamethyl cyclotrisiloxane, octamethyl cyclotetrasiloxane, decamethyl cyclopentasiloxane or dodecamethyl cyclohexasiloxane; a cyclic methylphenyl cyclosiloxane such as 1,3,5-trimethyl-1,3,5-triphenyl cyclotrisiloxane, 1,3,5,7-tetramethyl-1,3,5,7-tetraphenyl cyclotetrasiloxane, or 1,3,5,7,9-pentamethyl-1,3,5,7,9-pentaphenyl cyclopentasiloxane; a cyclic phenyl cyclosiloxane such as hexaphenyl cyclotrisiloxane; a fluorine-containing cyclosiloxane such as 3-(3,3,3-trifluoropropyl)methyl cyclotrisiloxane; a hydrosilyl group-containing cyclosiloxane such as a methyl hydrosiloxane mixture, pentamethyl cyclopentasiloxane or phenylhydro cyclosiloxane; and a vinyl group-containing cyclosiloxane such as pentavinyl pentamethyl cyclopentasiloxane.

It is also possible to use additives such as a plasticizer, a surface modifier, an antioxidant, a photodeterioration preventing agent, etc. Examples of the plasticizer include biphenyl, chlorobiphenyl, terphenyl, dibutyl phthalate, diethylene glycol phthalate, dioctyl phthalate, triphenyl phosphate, nethylnaphthalene, benzophenone, chlorinated paraffin, polypropylene, polystyrene and various fluorohydrocarbons.

A siloxane resin, having a charge transporting property and a crosslinked structure, shows an excellent mechanical strength and a sufficient photoelectric property, so that it may be directly employed as a charge transporting layer of a laminar photoreceptor. In such case, there can be employed an ordinary method such as blade coating, Mayer bar coating, spray coating, dip coating, bead coating, air knife coating or curtain coating. However, in the case where a necessary film thickness cannot be obtained by a single coating, such necessary film thickness can be obtained by superposing the coating plural times. In the case of superposed coatings of plural times, the heating treatment may be executed for each coating or after superposed coatings of plural times.

The single-layered photosensitive layer 8 is constituted by including a charge generating material, a charge transport material and a binder resin. The binder resin can be similar to that employed in the charge generating layer and the charge transport layer. The content of the charge generating material in the single-layered photosensitive layer is preferably 10 to 85 wt. %, more preferably 20 to 50 wt. %. The single-layered photosensitive layer 8 may be added with a charge transport substance or a polymer charge transport substance for example for improving the photoelectric characteristics. The amount of addition is preferably 5 to 50 wt. %. Also a compound represented by the general formula (I) may be added. A solvent employed for coating or a coating method can be similar to those explained in the foregoing. A film thickness is preferably about 5 to 50 μm, more preferably 10 to 40 μm.

A half decay exposure amount of the electrophotographic photoreceptor of the invention is not particularly restricted as long as the quantum efficiency satisfies the condition represented by the aforementioned expression (A), but it is preferred that, when the electrophotographic photoreceptor is so charged as to reach a charged potential absolute value of 500 V and then irradiated with a monochromatic light of the same wavelength as that of the light beams to decay the charged potential absolute value to 250 V, a half decay exposure amount satisfies the relationship represented by the aforementioned expression (A). A condition that the half decay exposure amount satisfies the condition of the expression (A) allows to more securely prevent the streak-shaped density unevenness and, in the case of a surface emitting laser array with a narrower control range of the light emission amount, to reduce the load on the exposure unit.

Figure 7:
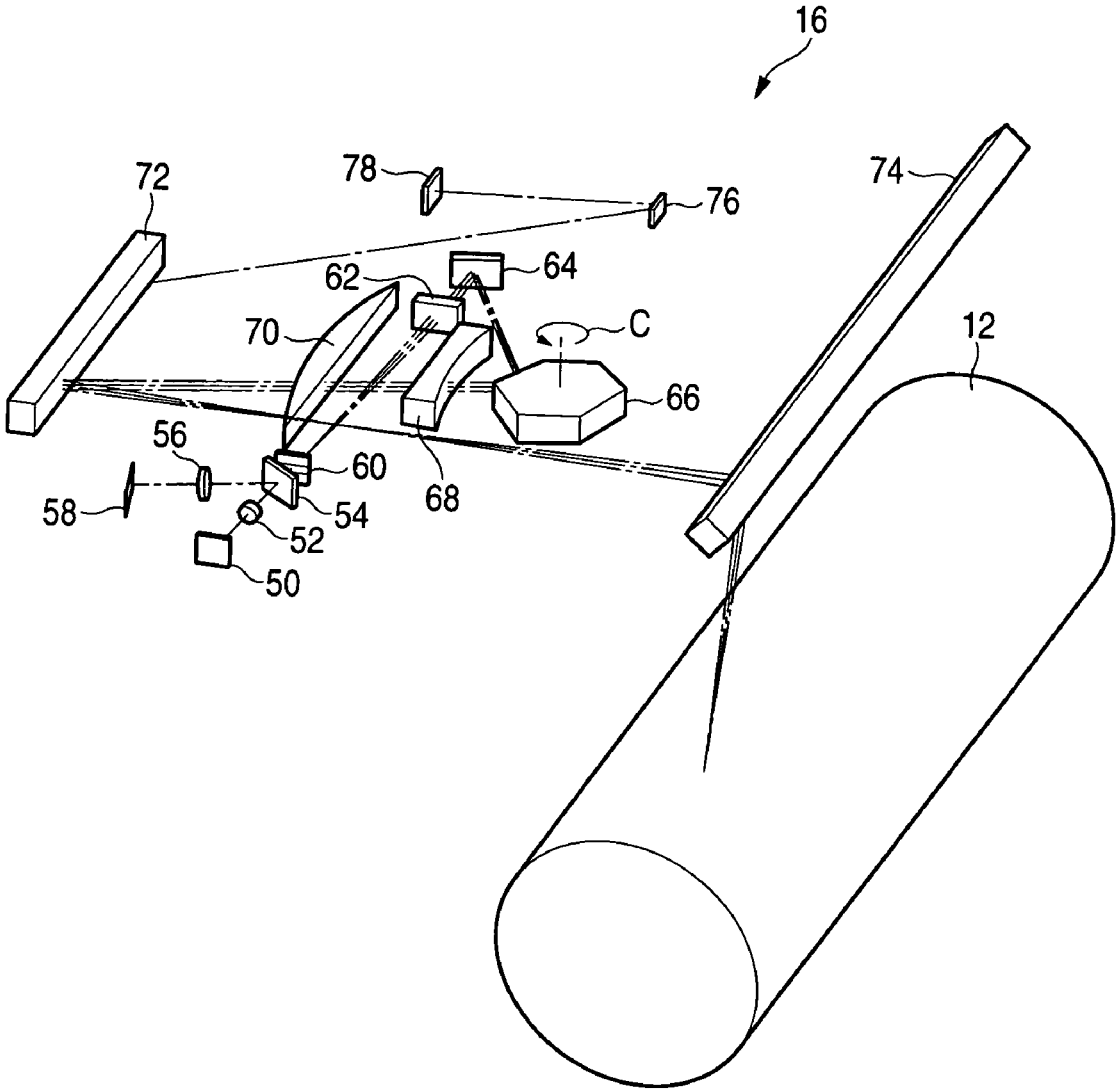
FIG. 7 is a schematic configurational view showing an example of an exposure unit (optical scanning apparatus) of the present invention.

In the following, reference is made to FIG. 7 for explaining the exposure unit 16. The exposure unit 16 is provided with a surface emitting laser array 50 which emits m laser beams (m being at least 8). FIG. 7 illustrates only 3 laser beams for the purpose of simplicity, but the surface emitting laser array 50, formed by an array of planar light-emission laser, can be so constructed as to emit for example several tens of laser beams, and the arrangement of the planar light-emission lasers (arrangement of laser beams emitted from the surface emitting laser array 50) is not limited to a one-dimensional array but can also be a two-dimensional array (for example in a matrix arrangement).

Figure 8:
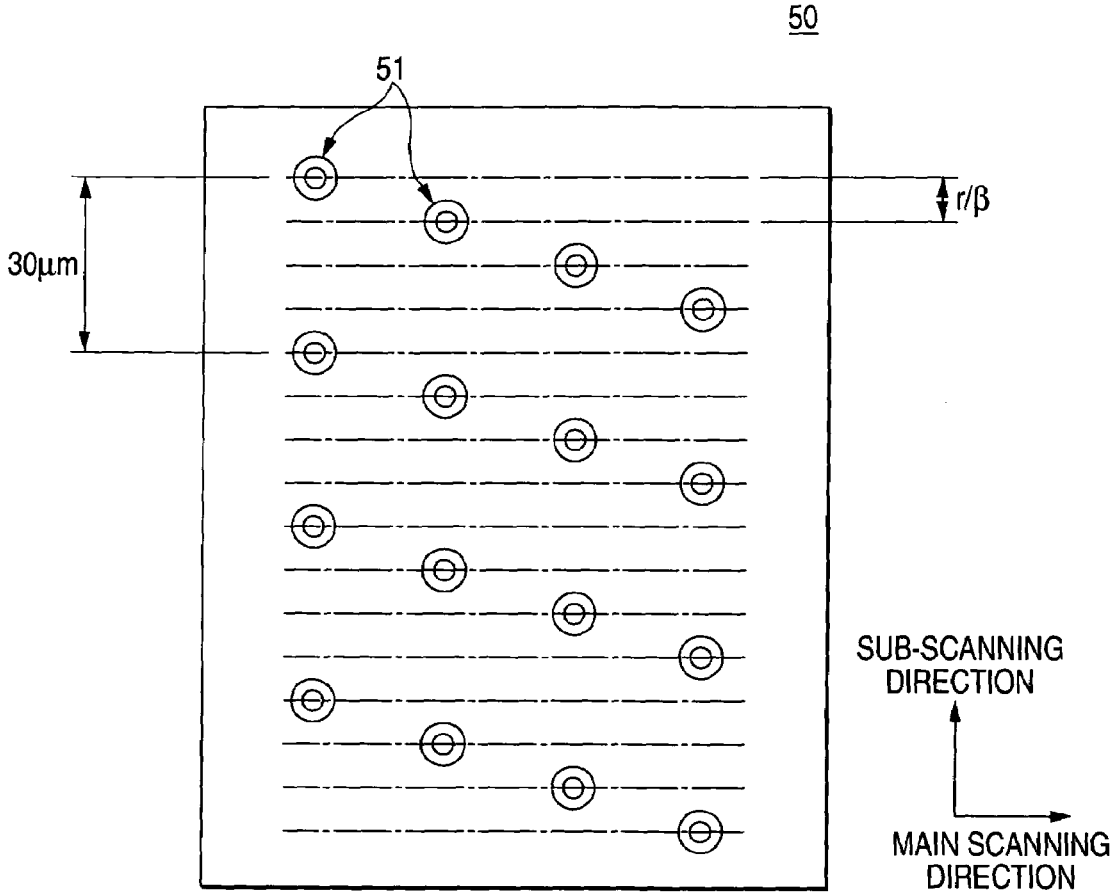
FIG. 8 is a plan view showing a laser array in which light emission points are arranged two-dimensionally.

FIG. 8 is a plan view showing a laser array 50 in which light emitting points are arranged two-dimensionally. As illustrated, the laser array 50 has 16 light emitting points 51, which are two-dimensionally arranged with 4 points in a main scanning direction and 4 points in a sub-scanning direction with a predetermined pitch. The light emitting points 51 in the main scanning direction are arranged with successive displacements of one step each, which is ¼ of a distance of the light emitting points 51 adjacent in the sub-scanning direction. Thus, considering the sub-scanning direction only, a light emitting point 51 is provided at each step. Thus, by arranging the light emitting points 51 with stepwise displacements in the sub-scanning direction, all the light emitting points 51 can scan the mutually different scanning lines. In this manner, the laser array 50 scans 16 scan lines at the same time.

Again referring to FIG. 7, a collimating lens 52 and a half mirror 54 are arranged sequentially at a laser beam exit side of the surface emitting laser array 50. A laser beam emitted from the surface emitting laser array 50 is formed into a substantially parallel light beam by the collimating lens 52, then enters the half mirror 54 and is partly separated and reflected by the half mirror 54. At a laser beam reflection side of the half mirror 54, a lens 56 and a light amount sensor 58 are provided sequentially, and a partial laser beam, separated and reflected by the half mirror 54 from the main laser beam (laser beam used for exposure) enters the light amount sensor 58 through the lens 56, whereby the light amount is detected by the light amount sensor 58.

The planar light emission laser does not emit a laser beam from a side opposite to the side which emits the laser beam used for exposure (end face light emission laser emits light from both sides). Therefore, for detecting and controlling the light amount of the laser beam, it is necessary to separate a part of the laser beam used for the exposure, for the light amount detection.

At a main laser beam exit side of the half mirror 54, there are arranged sequentially an aperture 60, a cylindrical lens 62 having a power only in the sub-scanning direction, and a fold-back mirror 64, whereby the main laser beam emitted from the half mirror 54 is shaped by the aperture 60, then refracted by the cylindrical lens 62 so as to be focused in a linear form elongated in the main scanning direction in the vicinity of a rotary polygon mirror 66, and is reflected by the fold-back mirror 64 toward the rotary polygon mirror 66. The aperture 60 is preferably positioned in the vicinity of a focal point of the collimating lens 52, in order to uniformly shape plural laser beams.

The rotary polygon mirror 66 is rotated in a direction C shown in FIG. 7 by a driving force of an unrepresented motor, and reflects and deflects the entering laser beam, reflected by the fold-back mirror 64, along the main scanning direction. At a laser beam exit side of the rotary polygon mirror 66, there are provided Fθ lenses 68, 70 having a power only in the main scanning direction, and the laser beam reflected and deflected by the rotary polygon mirror 66 moves at a substantially constant speed on the external periphery of the electrophotographic photoreceptor 12 and is so refracted by the Fθ lenses 68, 70 that the focal position in the main scanning direction coincides with the external periphery of the electrophotographic photoreceptor 12.

At a laser beam exit side of the Fθ lenses 68, 70, there are provided sequentially cylindrical mirrors 72, 74 having a powder only in the sub-scanning direction, and the laser beam transmitted by the Fθ lenses 68, 70 is reflected by the cylindrical mirrors 72, 74 in such a manner that the focal position in the sub-scanning direction coincides with the external periphery of the electrophotographic photoreceptor 12 and irradiates the external periphery of the electrophotographic photoreceptor 12. The cylindrical mirrors 72, 74 also have an image inclination correcting function which maintains the rotary polygon mirror 66 and the external periphery of the electrophotographic photoreceptor 12 in a conjugate relationship.

Also at a laser beam exit side of the cylindrical mirror 72, a pickup mirror 76 is provided in a position corresponding to a scan starting end (SOS: start of scan) in the scanning range of the laser beam, and, at a laser beam exit side of the pickup mirror 76, a beam position detecting sensor 78 is provided. The laser beam emitted from the surface emitting laser array 50 is reflected by the pickup mirror 76 and enters the beam position detecting sensor 78 when a laser beam reflecting face within the reflecting faces of the rotary polygon mirror 66 is so directed as to reflect the entering beam to a direction corresponding to SOS (see imaginary line in FIG. 7).

A signal outputted from the beam position detecting sensor 78 is used for synchronizing a modulation start timing in each main scanning, in forming an electrostatic latent image by modulating the laser beam scanning on the external periphery of the electrophotographic photoreceptor 12 along with the rotation of the rotary polygon mirror 66.

Also in the exposure unit 16 of the present embodiment, the collimating lens 52, the cylindrical lens 62 and the two cylindrical mirrors 72, 74 are positioned in an afocal relationship in the sub-scanning direction. Such arrangement is adopted in order to suppress a difference in a scanning line curvature (BOW) in plural laser beams and a fluctuation in the gap of the scanning lines formed by the plural laser beams.

Figure 9:
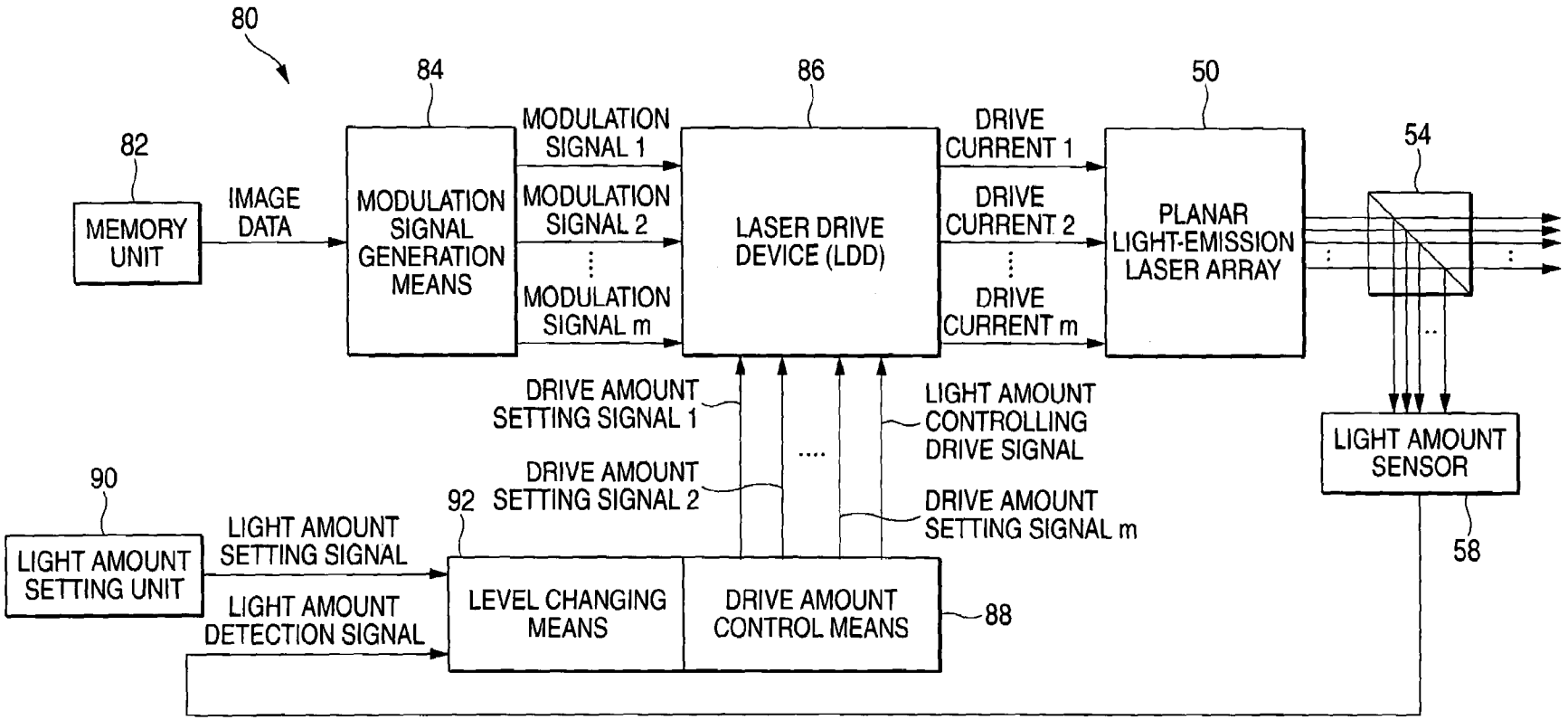
FIG. 9 is a schematic configurational view showing an example of a control unit of the invention.

In the following there will be explained, with reference to FIG. 9, a configuration of a part for controlling emission of laser beams from the surface emitting laser array 50 in the exposure unit 16 (such part being called a control unit 80). The control unit includes a memory unit 82 for storing image data representing an image to be formed by the image forming apparatus 10, and the image data stored in the memory unit 82 is entered into modulation signal generating means 84 of the control unit 80 at the image formation by the image forming apparatus 10.

Though not illustrated, the modulation signal generating means 84 is connected with the beam position detecting sensor 78. The modulation signal generating means 84 decomposes the image data, entered from the memory unit 82, into m image data respectively corresponding to m laser beams emitted from the surface emitting laser array 50, then generates, based on thus decomposed m image data, m modulation signals for defining the on-off timings for the m laser beams emitted from the surface emitting laser array 50, based on the SOS timing detected by the signal entered from the beam position detecting sensor 78, and outputs such signals to a laser drive device (LDD) 86.

The LDD 86, connected to drive amount control means 88 (to be described below), turns on and off the m laser beams emitted from the surface emitting laser array 50 at timings corresponding to the modulation signals entered from the modulation signal generating means 84, and generates m drive signals for setting the light amounts of the laser beams, when turned on, at values corresponding to drive amount setting signals entered from the drive amount control means 88, and supplies such currents respectively to the m planar lasers of the surface emitting laser array 50.

Thus the surface emitting laser array 50 emits m laser beams which are turned on and off at timings corresponding to the modulation signals and of which light amount in the on-state corresponds to the drive amount setting signals, and such m laser beams scan and expose the external periphery of the electrophotographic photoreceptor 12, thereby forming an electrostatic latent image thereon. Such electrostatic latent image is developed by the developing unit 18 as a toner image, which is transferred onto a paper P through a transfer step by transfer devices 42, 44 and is fixed by fusion on the paper P in the fixing device 44, whereby an image is recorded on the paper P.

On the other hand, the image forming apparatus 10 is equipped with a density sensor (not shown) for detecting a density of either of a toner image formed on the external periphery of the electrophotographic photoreceptor 12, a toner image transferred onto the external periphery of the intermediate transfer belt 24 and an image recorded on the paper P, and such density sensor is connected to the control unit 80. In the case of forming an image (more exactly an electrostatic latent image) by scanning and exposing the external periphery of the electrophotographic photoreceptor 12 simultaneously with plural (m) laser beams as in the present embodiment, the irradiation (exposure) with the laser beam is executed twice in the vicinity of a boundary of the scanning area by the m laser beams in each main scanning.

The present invention is not limited to the embodiment explained in the foregoing. For example, FIG. 1 shows a configuration employing a corotron as the charging unit, but there may also be employed a charging unit of contact charging method utilizing a charging roller or a charging brush.

A developer to be employed in the image forming apparatus of the invention can be a one-component type or a two-component type, and can also be a normal developer or a reversal developer.

Also the image forming apparatus of the invention can be of an intermediate transfer type in which a toner image on an electrophotographic photoreceptor is transferred onto an intermediate transfer member and is then transferred to a transferred image-receiving medium.

Also the image forming apparatus of the invention can be, in addition to a configuration shown in FIG. 1, an image forming apparatus for a black-and-white image or a color image forming apparatus of a tandem type.

EXAMPLES

The present invention will be illustrated in greater detail with reference to the following Examples and Comparative Examples, but the invention should not be construed as being limited thereto.

Example 1

An ED tubular aluminum substrate is subjected, on an external periphery thereof, to a liquid honing treatment with fine spherical alumina powder with D50 of 30 μm to obtain a conductive substrate with a diameter of 30 mm and with a surface roughed to a center line average roughness Ra of 0.18 μm.

Then, 170 parts by weight of an n-butyl alcohol solution in which 4 parts by weight of polyvinyl butyral resin (Esrec BM-S; manufactured by Sekisui Chemical Co.) are added with 30 parts by weight of an organic zirconium compound (acetylacetone zirconium butylate) and 3 parts by weight of an organic silane compound (γ-aminopropyl triethoxysilane) and are mixed under agitation to obtain a coating liquid for forming an undercoat layer. The obtained coating liquid is coated by a dip coating apparatus on the external periphery of the aforementioned substrate and is air dried for 5 minutes at the room temperature, and the substrate is then heated to 50° C. over 10 minutes and is subjected to a hardening accelerating treatment for 20 minutes in a thermostat box of 50° C., 85% RH (dew point 47° C.). After the treatment, the substrate is dried for 10 minutes at 170° C. in a hot air dryer to obtain an undercoat layer of a thickness of 1.0 μm.

Then a mixture of 4 parts by weight of hydroxygallium phthalocyanine, represented by the following formula (12) and having diffraction peaks at least at 7.6° and 28.2° in the Bragg angle (2θ±0.2°) of an X-ray diffraction spectrum utilizing CuKα ray, 1 part by weight of vinyl chloride-vinyl acetate copolymer resin (VMCH, manufactured by Nippon Unicar Co.) and 120 parts by weight of n-butyl acetate is subjected to a dispersion in a sand mill for 4 hours to obtain a coating liquid for the charge generating layer. The obtained coating liquid is dip coated on the undercoat layer mentioned above, and is dried to obtain a charge generating layer of a thickness of 0.2 μm.

(12)

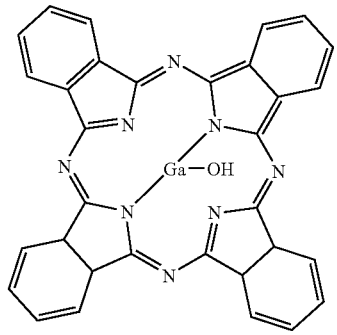

Then, 5 parts by weight of N,N'-diphenyl-N,N'-bis(3-methylphenyl)-[1,1']biphenyl-4,4'-diamine as a charge transport material, 5 parts by weight of bisphenopl-Z based polycarbonate resin (viscosity-averaged molecular weight: 40,000), 80 parts by weight of tetrahydrofuran, and 0.2 parts by weight of 2,6-di-t-butyl-4-methylphenol are mixed to obtain a coating liquid for the charge transport layer. This coating liquid is coated on th charge generating layer and is dried for 40 minutes at 120° C. to obtain a charge transport layer of a thickness of 28 μm, thereby completing a desired electrophotographic photoreceptor.

The electrophotographic photoreceptor thus obtained is employed to prepare an image forming apparatus of a configuration shown in FIG. 1. The exposure unit employs a surface emitting laser array having light emission points in a two-dimensional arrangement of 6×6, laser beams of a number m=32, a laser wavelength of 780 nm, and a scanning line density of 2400 dpi.

Example 2

There are prepared an electrophotographic photoreceptor and an image forming apparatus in the same manner as in the Example 1, except that hydroxygallium phthalocyanine employed as the charge generating material in the Example 1 is replaced by chlorogallium phthalocyanine, represented by the following formula (13) and having diffraction peaks at least at 7.4°, 16.6°, 25.5° and 28.3° in the Bragg angle (2θ±0.2°) of an X-ray diffraction spectrum utilizing CuKα ray.

(13)

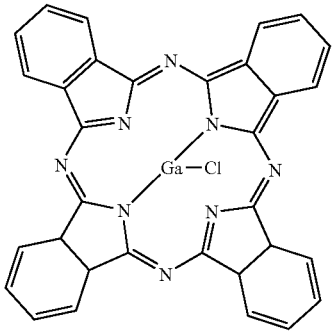

Example 3

There are prepared an electrophotographic photoreceptor and an image forming apparatus in the same manner as in the Example 1, except that hydroxygallium phthalocyanine employed as the charge generating material in the Example 1 is replaced by a trisazo pigment represented by the following formula (14):

(14)

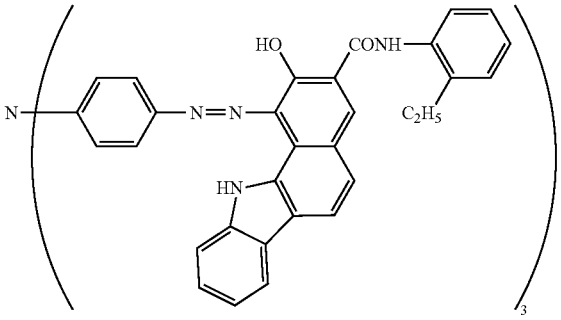

Example 4

There are prepared an electrophotographic photoreceptor and an image forming apparatus in the same manner as in the Example 1, except that hydroxygallium phthalocyanine employed as the charge generating material in the Example 1 is replaced by a trisazo pigment represented by the following formula (15):

(15)

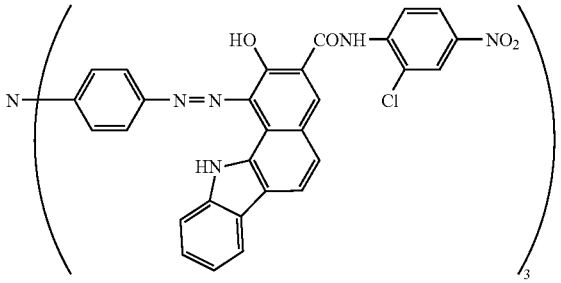

Example 5

There are prepared an electrophotographic photoreceptor and an image forming apparatus in the same manner as in the Example 1, except that hydroxygallium phthalocyanine employed as the charge generating material in the Example 1 is replaced by oxytitanium phthalocyanine, having a diffraction peak at least at 27.3° in the Bragg angle (2θ±0.2°) of an X-ray diffraction spectrum utilizing CuKα ray.

Comparative Example 1

There are prepared an electrophotographic photoreceptor and an image forming apparatus in the same manner as in the Example 1, except that hydroxygallium phthalocyanine employed as the charge generating material in the Example 1 is replaced by x-type metal-free phthalocyanine.

Example 6

At first an aluminum substrate of a diameter of 30 mm, a length of 340 mm and a thickness of 1 mm is prepared.

Then a mixture of 100 parts by weight of zinc oxide (average particle size 70 nm; a trial product by Teika Co.) and 500 parts by weight of toluene are agitated, and, after an addition of 1.5 parts by weight of a silane coupling agent (KBM603, manufactured by Shin-etsu Chemical Co.), is further agitated for 2 hours. Then toluene is removed by distillation under a reduced pressure, and a baking is executed for 2 hours at 150° C.

60 parts by weight of zinc oxide subjected to such surface treatment are dissolved, together with 15 parts by weight of a hardening agent (block isocyanate Sumidur 3175; manufacture by Sumitomo Bayer Urethane Co.) and 15 parts by weight of butyral resin (BM-1; manufactured by Sekisui Chemical Co.), in 85 parts by weight of methyl ethyl ketone to obtain a solution. 38 parts by weight of this solution are mixed with 25 parts by weight of methyl ethyl ketone and are subjected to a dispersion process for 2 hours in a sand mill, utilizing glass beads of a diameter of 1 mm, thereby obtaining a dispersion. To the obtained dispersion, 3.5 parts by weight of silicone resin balls of an average particle size of 4.5 μm (Tospearl 145; manufactured by GE Silicone Co.) and 0.005 parts by weight of dioctyl tin dilaurate as a catalyst are added under agitation to obtain a coating liquid for forming the undercoat layer. The coating liquid is dip coated on the aforementioned substrate and is dried and hardened for 100 minutes at 160° C. to obtain an undercoat layer of a thickness of 20 μm.

Then a mixture of 4 parts by weight of hydroxygallium phthalocyanine, represented by the foregoing formula (12) and having diffraction peaks at least at 7.6° and 28.2° in the Bragg angle (2θ±0.2°) of an X-ray diffraction spectrum utilizing CuKα ray, 1 part by weight of vinyl chloride-vinyl acetate copolymer resin (VMCH, manufactured by Nippon Unicar Co.) and 120 parts by weight of n-butyl acetate is subjected to a dispersion in a sand mill for 4 hours to obtain a coating liquid for the charge generating layer. The obtained coating liquid is dip coated on the aforementioned undercoat layer, and is dried to obtain a charge generating layer of a thickness of 0.2 μm.

Then, 5 parts by weight of N,N'-diphenyl-N,N'-bis(3-methylphenyl)-[1,1']biphenyl-4,4'-diamine as a charge transport material, 5 parts by weight of bisphenopl-Z based polycarbonate resin (viscosity-averaged molecular weight: 40,000), 80 parts by weight of tetrahydrofuran, and 0.2 parts by weight of 2,6-di-t-butyl-4-methylphenol are mixed to obtain a coating liquid for the charge transport layer. This coating liquid is coated on the charge generating layer and is dried for 40 minutes at 120° C. to obtain a charge transport layer of a thickness of 28 μm, thereby completing a desired electrophotographic photoreceptor.

Example 7

There are prepared an electrophotographic photoreceptor and an image forming apparatus in the same manner as in the Example 6, except that hydroxygallium phthalocyanine employed as the charge generating material in the Example 6 is replaced by chlorogallium phthalocyanine, represented by the foregoing formula (13) and having diffraction peaks at least at 7.4°, 16.6°, 25.5° and 28.3° in the Bragg angle (2θ±0.2°) of an X-ray diffraction spectrum utilizing CuKα ray.

Example 8

There are prepared an electrophotographic photoreceptor and an image forming apparatus in the same manner as in the Example 6, except that hydroxygallium phthalocyanine employed as the charge generating material in the Example 6 is replaced by a trisazo pigment represented by the foregoing formula (14).

Example 9

There are prepared an electrophotographic photoreceptor and an image forming apparatus in the same manner as in the Example 6, except that hydroxygallium phthalocyanine employed as the charge generating material in the Example 6 is replaced by a trisazo pigment represented by the foregoing formula (16).

Example 10

There are prepared an electrophotographic photoreceptor and an image forming apparatus in the same manner as in the Example 6, except that hydroxygallium phthalocyanine employed as the charge generating material in the Example 6 is replaced by oxytitanium phthalocyanine, having a diffraction peak at least at 27.3° in the Bragg angle (2θ±0.2°) of an X-ray diffraction spectrum utilizing CuKα ray.

Comparative Example 2

There are prepared an electrophotographic photoreceptor and an image forming apparatus in the same manner as in the Example 6, except that hydroxygallium phthalocyanine employed as the charge generating material in the Example 6 is replaced by x-type metal-free phthalocyanine.

Measurement of Half Decay Exposure Amount E1/2

On each of the electrophotographic photoreceptors obtained in the Examples 1 to 10 and the Comparative Examples 1 and 2, a half decay exposure amount is measured in the following manner.

Figure 10:
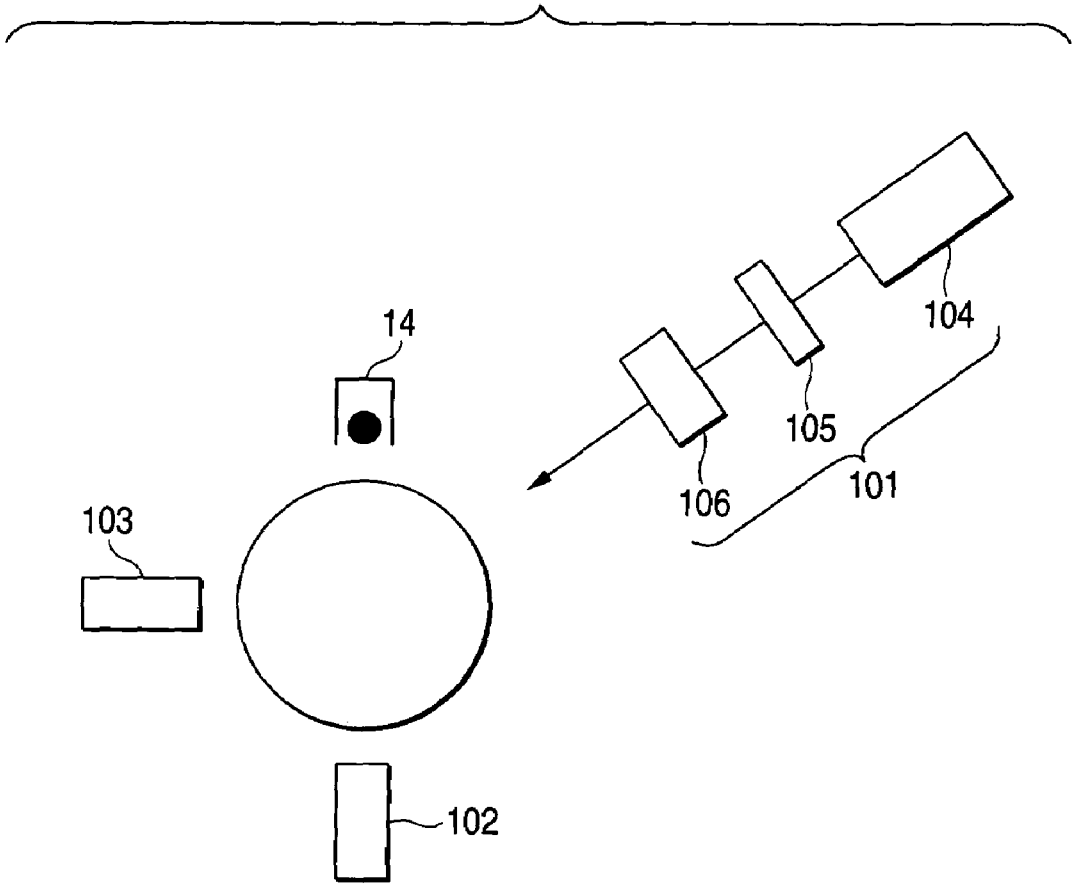
FIG. 10 is a schematic configurational view showing a measuring apparatus for a half decay exposure amount.
Figure 11:
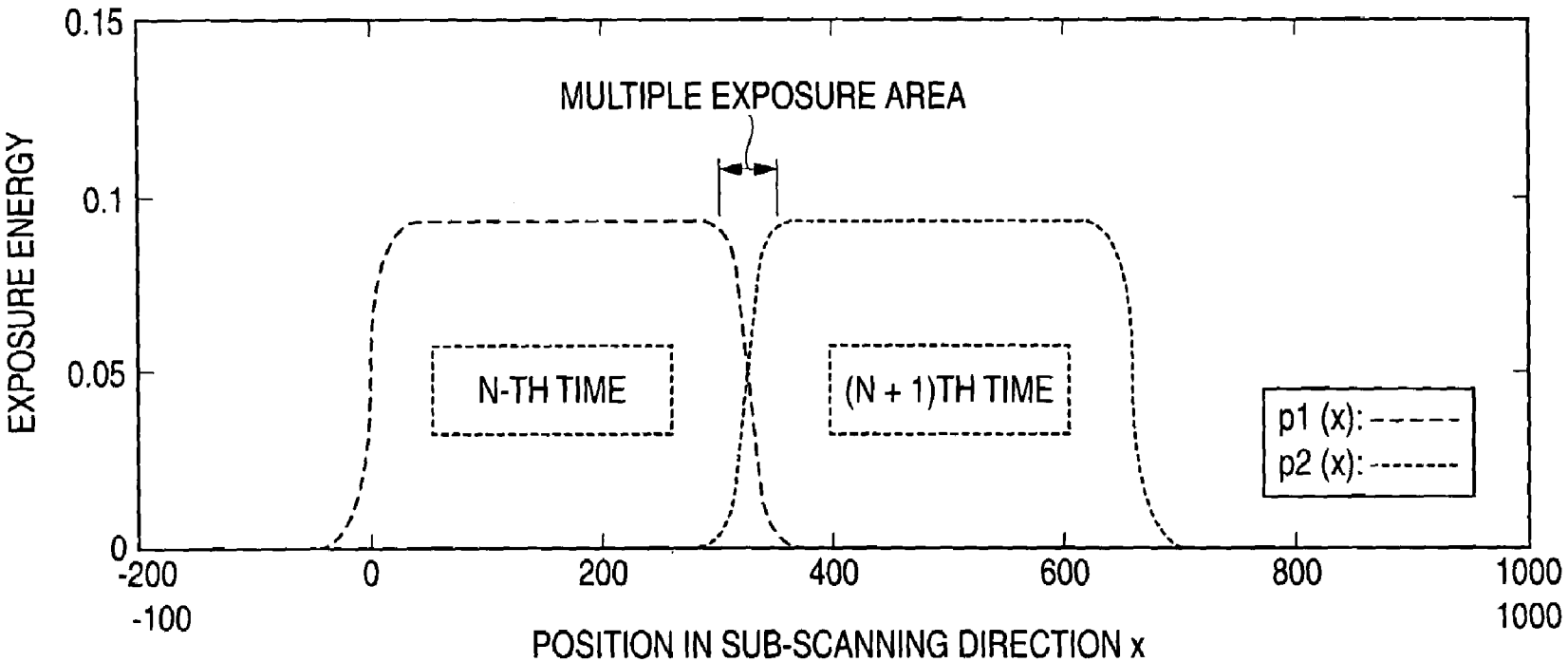
FIG. 11 is a chart showing a distribution of exposure energy along a moving direction (sub-scanning direction) of an electrophotographic photoreceptor.

FIG. 10 is a schematic view showing an apparatus employed for measuring the half decay exposure amount. An electrophotographic photoreceptor 12 is rendered rotatable at a constant speed about a central axis of the cylinder. Around the electrophotographic photoreceptor 12 and along the rotating direction thereof, there are provided sequentially a charging unit (scorotron) 14, an exposure unit 101, a potential measuring apparatus 102 and a charge eliminating exposure unit 103. A light emitted from a white light source 104 in the exposure unit 101 is made monochromatic by a band-pass filter 105 and enters the electrophotographic photoreceptor 12. The amount of such incident light is regulated by a light amount regulating apparatus 106 formed by a combination of plural ND filters and an opaque plate. The exposure unit 101 is so positioned that the incident light has an angle of 45° with respect to a line connecting the central axis of the electrophotographic photoreceptor 12 and the charging unit 14. Also the potential measuring apparatus 102 and the charge eliminating exposure unit 103 are respectively placed in positions of 180° and 270° about the central axis of the electrophotographic photoreceptor 12, with respect to the charging unit 14.

In the above-described apparatus, after the electrophotographic photoreceptor 12 is charged to a charged potential of −500 V based on a potential at a 0 exposure amount, and it is irradiated with a monochromatic light of a wavelength of 780 nm from the exposure unit 101. In this operation, a potential obtained by the potential measuring apparatus 102 (potential after exposure) is measured with a change in the exposure amount to obtain a potential decay curve as a function of the exposure amount, and there are determined an exposure amount (half decay exposure amount) at which the potential after exposure becomes ½ (−250 V) of the charged potential and a quantum efficiency. Table 2 shows a half decay exposure amount $E_L$ measured at 10° C., 15% RH, a half decay exposure amount $E_M$ measured at 22° C., 50% RH, and a ratio $E_L/E_M$ thereof. The charge eliminating exposure unit 103 has an exposure wavelength of 650 nm.

Evaluation of Image Quality

On each of the image forming apparatus of the Examples 1 to 10 and the Comparative Examples 1 to 2, a printing test is conducted under a condition of 22° C., 50% RH to investigate the presence of streak-shaped density unevenness. Obtained results are shown in Table 2. In Table 2, A indicates that the streak-shaped density unevenness is completely absent or extremely slight; B indicates that the streak-shaped density unevenness is slight; and C indicates that the streak-shaped density unevenness is conspicuous.

Evaluation of Charge Mobility

A charge mobility of the charge transport layer formed in the electrophotographic photoreceptor is measured by XTOF method. The charge transport layer formed in common in the Examples 1 to 10 has a charge mobility at an electric field of 20 V/μm of $1.04\times10^{-5}$ $cm^2/V\cdot s$.

TABLE 2

| | Half decay exposure amount ($mJ/m^2$) | | | | |
|---|---|---|---|---|---|
| | $E_L$ (10° C., 15% RH) | $E_M$ (22° C., 50% RH) | $E_L/E_M$ | Quantum efficiency | Image quality |
| Example 1 | 1.05 | 0.99 | 1.07 | 0.62 | A |
| Example 2 | 1.95 | 1.75 | 1.11 | 0.35 | B |
| Example 3 | 1.07 | 0.98 | 1.09 | 0.62 | A |
| Example 4 | 1.02 | 0.95 | 1.07 | 0.64 | A |
| Example 5 | 1.14 | 0.95 | 1.20 | 0.64 | A |
| Comp. Ex. 1 | 4.0 | 3.8 | 1.05 | 0.16 | C |
| Example 6 | 0.94 | 0.89 | 1.06 | 0.69 | A |
| Example 7 | 1.75 | 1.61 | 1.09 | 0.38 | B |
| Example 8 | 1.05 | 0.95 | 1.10 | 0.64 | A |
| Example 9 | 0.96 | 0.90 | 1.07 | 0.68 | A |
| Example 10 | 1.03 | 0.87 | 1.18 | 0.70 | A |
| Comp. Ex. 2 | 3.9 | 3.5 | 1.11 | 0.17 | C |

As explained in the foregoing, the image forming apparatus of the invention, even in the case of employing a surface emitting laser array which can increase the number of lasers, can sufficiently suppress generation of streak-shaped density unevenness, thereby achieving both an increase in the image forming speed and an improvement in the image quality.

While the present invention has been described in detail and with reference to specific embodiments thereof, it will be apparent to one skilled in the art that various changes and modifications can be made therein without departing from the spirit and scope thereof.

This application is based on Japanese Application No. 2003-075993 filed Mar. 19, 2003, the contents thereof being herein incorporated by reference.

What is claimed is:

1. An image forming apparatus comprising:

an electrophotographic photoreceptor having a conductive substrate and a photosensitive layer provided on the conductive substrate;

a charging unit that charges the electrophotographic photoreceptor;

an exposure unit that exposes the charged electrophotographic photoreceptor to light thereby forming an electrostatic latent image;

a developing unit that developes the electrostatic latent image with toner thereby forming a toner image; and a transfer unit that transfers the toner image from the electrophotographic photoreceptor to a transferred image-receiving medium, wherein said exposure unit is a multi beam exposure unit which has a surface emitting laser array and which carries out the electrostatic latent image formation by scanning the electrophotographic photoreceptor with eight or more light beams, wherein said electrophotographic photoreceptor gives a quantum efficiency of 0.3 or higher when the electrophotographic photoreceptor is charged to a charged potential absolute value of 500 V and then irradiated with a monochromatic light of the same wavelength as that of said light beams to decay the charged potential absolute value to 250 V, and wherein the light beams emitted by the exposure unit have a wavelength of 780 nm.

2. The image forming apparatus according to claim 1, wherein said photosensitive layer comprises at least one charge generating material selected from the group consisting of hydroxygallium phthalocyanine, chlorogallium phthalocyanine, oxytitanium phthalocyanine and a trisazo pigment.

3. The image forming apparatus according to claim 1, wherein said photosensitive layer includes at least one member selected from the group consisting of:

hydroxygallium phthalocyanine having diffraction peaks at least at 7.6° and 28.2° in terms of the Bragg angle (2θ±0.2°) of an X-ray diffraction spectrum using CuKα radiation;

chlorogallium phthalocyanine having diffraction peaks at least at 7.4°, 16.6°, 25.5° and 28.3° in terms of the Bragg angle (2θ±0.2°) of an X-ray diffraction spectrum using CuKα radiation; and a trisazo pigment represented by either one of following general formulas (1) to (4):

(1)

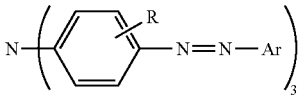

-continued (2)

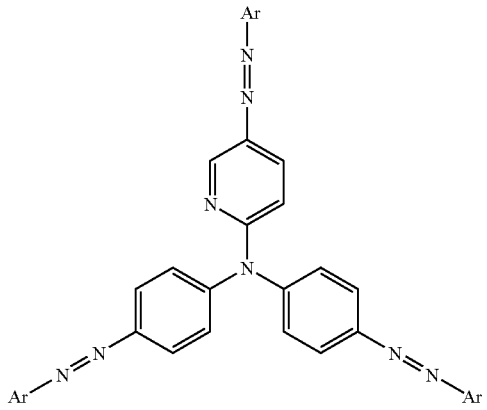

(3)

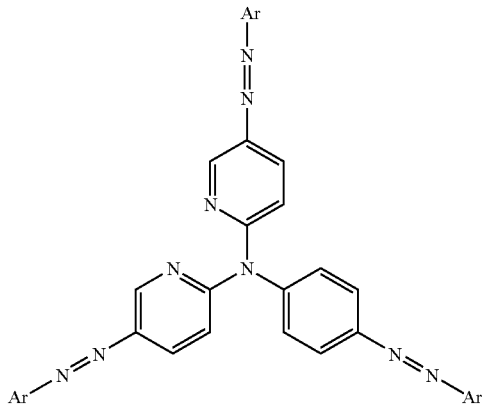

(4)

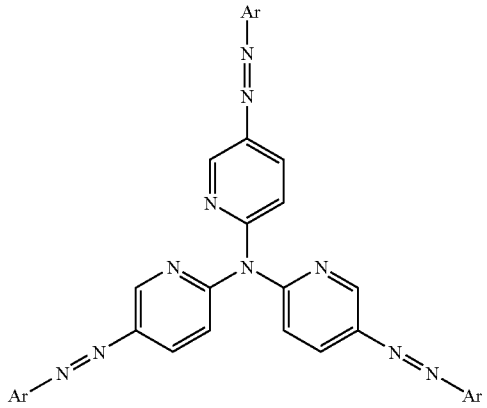

wherein, in the formulas (1) to (4), R represents a hydrogen atom, a halogen atom, an alkyl group, an alkoxy group or a cyano group; and Ar represents a coupler residue.

4. The image forming apparatus according to claim 1, having a resolution of 1200 dpi or higher.

5. The image forming apparatus according to claim 1, having a resolution of 2400 dpi or higher.

6. The image forming apparatus according to claim 1, wherein said surface emitting laser array has light emitting points arranged two-dimensionally.

7. The image forming apparatus according to claim 1, wherein the exposure unit gives a scanning interval between adjacent light beams scanning on the electrophotographic photoreceptor of 0.15 mm or larger.

8. The image forming apparatus according to claim 1, wherein the exposure unit gives a scanning interval between adjacent light beams scanning on the electrophotographic photoreceptor of 0.2 mm or larger.

9. The image forming apparatus according to claim 1, wherein the exposure unit gives a scanning interval between adjacent light beams scanning on the electrophotographic photoreceptor of 0.3 mm or larger.

10. The image forming apparatus according to claim 1, which gives half decay exposure amounts, as determined by charging the electrophotographic photoreceptor to a charged potential absolute value of 500 V and then irradiating with a monochromatic light of the same wavelength as that of said light beams to decay the charged potential absolute value to 250 V, satisfying the relationship represented by the following expression (A):

$$E_L/E_M \leqq 1.15 \quad \text{(A)}$$

wherein $E_L$ represents a half decay exposure amount under the conditions of 10° C. and 15% RH, and $E_M$ represents a half decay exposure amount under the conditions of 22° C. and 50% RH.

* * * * *